US009868152B2

(12) United States Patent
Funakoshi et al.

(10) Patent No.: US 9,868,152 B2
(45) Date of Patent: Jan. 16, 2018

(54) CASTING FACILITY

(71) Applicant: SINTOKOGIO, LTD., Nagoya-shi, Aichi (JP)

(72) Inventors: Yukiyoshi Funakoshi, Toyokawa (JP); Keishiro Kaneda, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/518,852

(22) PCT Filed: Aug. 10, 2015

(86) PCT No.: PCT/JP2015/072698

§ 371 (c)(1),
(2) Date: Apr. 13, 2017

(87) PCT Pub. No.: WO2016/166903

PCT Pub. Date: Oct. 20, 2016

(65) Prior Publication Data

US 2017/0225226 A1 Aug. 10, 2017

(30) Foreign Application Priority Data

Apr. 14, 2015 (JP) ..... 2015-082564

(51) Int. Cl.

| | |
|---|---|
| ***B22D 33/02*** | (2006.01) |
| ***B22D 23/00*** | (2006.01) |
| ***B22C 9/06*** | (2006.01) |
| ***B22D 27/08*** | (2006.01) |

(52) U.S. Cl.

CPC ..... *B22D 23/006* (2013.01); *B22C 9/062* (2013.01); *B22D 23/00* (2013.01); *B22D 27/08* (2013.01); *B22D 33/02* (2013.01)

(58) Field of Classification Search

CPC ..... B22D 23/00; B22D 27/08; B22D 33/02
USPC ..... 164/336
See application file for complete search history.

(56) References Cited

U.S. PATENT DOCUMENTS 6,942,010 B2 * 9/2005 Osugi ..... B22D 23/006 164/336

FOREIGN PATENT DOCUMENTS

| | | | |
|---|---|---|---|
| JP | H09-225622 A | | 9/1997 |
| JP | 2003-205359 A | | 7/2003 |
| JP | 2005118783 A | * | 5/2005 |
| JP | 2007-54850 A | | 3/2007 |
| JP | 2010-5649 A | | 1/2010 |

(Continued)

OTHER PUBLICATIONS

International Preliminary Report on Patentability (IPRP) dated Oct. 26, 2017 that issued in WO Patent Application No. PCT/JP2015/072698.

*Primary Examiner* — Kevin E Yoon
(74) *Attorney, Agent, or Firm* — Drinker Biddle & Reath LLP

(57) ABSTRACT

A casting apparatus of a casting equipment includes an upper frame to which an upper mold is attached, a lower frame to which a lower mold is attached, a mold closing mechanism, a pair of main link members each of which has a central portion provided with a rotating shaft, a pair of auxiliary link members each of which has a central portion provided with a rotating shaft, and a drive means. The upper frame, the lower frame, the main link member, and the auxiliary link member constitute a parallel link mechanism.

20 Claims, 19 Drawing Sheets

(56) References Cited

FOREIGN PATENT DOCUMENTS

| | | | | |
|---|---|---|---|---|
| TW | 537939 B | 6/2003 | | |
| WO | WO 2016103763 A1 * | 6/2016 | ..... | B22C 9/062 |

* cited by examiner

CASTING FACILITY

TECHNICAL FIELD

The present disclosure relates to casting equipment.

BACKGROUND ART

Patent Literatures 1 and 2 disclose gravity tilting mold casting apparatuses. The apparatuses include upper and lower molds which can be opened, closed, and tilted, and which cast a product by pouring molten metal into the upper and lower molds by using gravity while turning and tilting the upper and lower molds closed. The apparatuses adopt an upper mold flip-up method in which the upper mold opens at approximately 90 degrees so that the upper mold shifts from a horizontal state to an erected state. The apparatus of the upper mold flip-up method is provided with an actuator in each of a flip-up mechanism, a stopper for mold closing, a tilting mechanism, a mold closing mechanism, a mold removal mechanism for each of upper and lower molds, and the like.

CITATION LIST

Patent Literature

Patent Literature 1: Japanese Patent Application Laid-Open No. 05-318090

Patent Literature 2: Japanese Patent Application Laid-Open No. 2003-205359

SUMMARY OF INVENTION

Technical Problem

Since the flip-up mechanism described above receives a large load at the time of mold closing, mold removal, and pushing out a product, the flip-up mechanism uses a high strength member with sufficient strength. In addition, since an actuator is provided in each of the flip-up mechanism, the stopper, the tilting mechanism, the mold closing mechanism, the mold removal mechanism for each of upper and lower molds, and the like, there are many actuators in the whole apparatus to form a complicated structure. Accordingly, if the upper mold flip-up method is adopted, the apparatus increases in size and weight. As a result, there is a possibility that casting equipment including an apparatus of the upper mold flip-up method may be required to secure a wide space for installation of the apparatus.

Thus, in the present technical field, it is desired to reduce a space occupied by casting equipment.

Solution to Problem

Casting equipment in accordance with one aspect of the present invention includes: a casting apparatus that forms a casting by using an upper mold and a lower mold, which can be opened, closed, and tilted, into which molten metal is poured by using gravity; a holding furnace that stores the molten metal to be used in the casting apparatus; and a pouring apparatus that transfers the molten metal to the casting apparatus from the holding furnace and pours the molten metal into the casting apparatus and the casting apparatus includes: an upper frame to which an upper mold is attached; a lower frame to which a lower mold is attached; a mold closing mechanism that is provided in the upper frame to move the upper mold up and down, or that is provided in the lower frame to move the lower mold up and down; a pair of main link members each of which has upper and lower ends that are rotatably coupled to the upper and lower frames, respectively, to be oppositely arranged, and has a central portion that is provided with a rotating shaft; a pair of auxiliary link members arranged parallel to the respective main link members, and each of which has upper and lower ends that are rotatably coupled to the upper and lower frames, respectively, to be oppositely arranged, and has a central portion that is provided with a rotating shaft; and a drive means that is provided to be coupled to the rotating shaft of one of the pair of main link members, and that tilts the upper mold and the lower mold or horizontally moves the molds away from each other, the upper frame, the lower frame, the main link member, and the auxiliary link member, constituting a parallel link mechanism.

In the casting apparatus of the casting equipment, the upper frame to which the upper mold is attached, and the lower frame to which the lower mold is attached, are coupled to each other by a left-and-right pair of the main link member and the auxiliary link member to constitute the parallel link mechanism, and the rotating shaft is provided at the central portion of each of the main link member and the auxiliary link member. Then, the drive means for tilting the upper mold and the lower mold or horizontally moving the molds away from each other is provided to be coupled to the rotating shaft of one of the pair of main link members. In addition, the upper mold or the lower mold is moved up and down by the mold closing mechanism. Accordingly, in a step of mold closing, the upper mold and the lower mold is closed by the mold closing mechanism, and in a step of tilting, the closed upper mold and lower mold are tilted by the drive means and the parallel link mechanism, and also in a step of mold removal or a step of pushing out a product, the upper mold and the lower mold opened by the mold closing mechanism are horizontally moved away from each other by the drive means and the parallel link mechanism. In this manner, a step of casting, such as mold closing, mold removal, and pushing out a product, is performed in the upper and lower frames coupled by the parallel link mechanism. In addition, force applied at the time of mold closing, mold removal, or pushing out a product, is to be received by the parallel link mechanism. As a result, as compared with an apparatus of the upper mold flip-up method, a structure for securing strength of each of members is simplified to enable the members to be reduced in weight and to be simplified. In addition, while large force is transferred to a base frame supporting the apparatus at the time of mold opening and the like in the apparatus of the upper mold flip-up method, the parallel link mechanism receives force in the casting apparatus of the casting equipment, whereby it is possible to reduce force to be transferred to the base frame supporting the apparatus. Accordingly, the base frame also can be reduced in weight and simplified. Reduction of the casting apparatus in size in this way enables a space occupied by the casting equipment to be reduced.

In one embodiment, the casting apparatus may further include a ladle attached to the lower mold, including a storage section formed inside the ladle for storing molten metal, and a pouring port connected to a receiving port of the lower mold, and wherein the pouring apparatus may pour the molten metal into the ladle when the upper mold and the lower mold are closed by the mold closing mechanism to become a mold closed state. In this case, since the molten metal is poured into the ladle when the upper mold and the lower mold become the mold closed state, it is possible to shorten time from a start of pouring the molten metal into the ladle to a start of pouring the molten metal into the upper mold and the lower mold in a tilted manner while the upper mold and the lower mold are tilted, as compared with a case where the molten metal is poured into the ladle before the upper mold and the lower mold become the mold closed state.

In another embodiment, the pouring apparatus and the casting apparatus may be communicatively connected to each other, and the casting apparatus may output information showing the mold closed state to the pouring apparatus when the upper mold and the lower mold are in the mold closed state, and then the pouring apparatus does not pour the molten metal into the ladle when receiving no information from the casting apparatus. In this way, since the pouring apparatus is configured not to pour the molten metal into the ladle when the upper mold and the lower mold are not in the mold closed state, a procedure, in which the pouring apparatus pours the molten metal in a state (posture) where the casting apparatus is ready to receive the molten metal, is obeyed to improve safety.

In yet another embodiment, the casting apparatus may further include a ladle attached to the lower mold, including a storage section formed inside the ladle for storing molten metal, and a pouring port connected to a receiving port of the lower mold, and in the casting apparatus, after the upper mold and the lower mold are opened by the mold closing mechanism, the pouring apparatus may pour the molten metal into the ladle when the upper mold is moved in a direction away from the pouring apparatus and the lower mold is moved in a direction approaching the pouring apparatus, by the drive means, to become a first separation state where the upper mold and the lower mold are horizontally separated from each other. In the first separation state, the ladle approaches the pouring apparatus as the lower mold is moved in the direction approaching the pouring apparatus. Thus, since a distance in which the pouring apparatus transfers the molten metal is shortened, a burden on the pouring apparatus is reduced.

In yet another embodiment, the pouring apparatus and the casting apparatus may be communicatively connected to each other, and the casting apparatus may output information showing the first separation state to the pouring apparatus when the upper mold and the lower mold are in the first separation state, and then the pouring apparatus does not pour the molten metal into the ladle when receiving no information from the casting apparatus. In this way, since the pouring apparatus is configured not to pour the molten metal into the ladle when the upper mold and the lower mold are not in the first separation state, a procedure, in which the pouring apparatus pours the molten metal in a state (posture) where the casting apparatus is ready to receive the molten metal, is obeyed to improve safety.

In yet another embodiment, the ladle may be attached to the lower mold while inclined in a tilt direction in which the upper mold and the lower mold are tilted. In this case, when the molten metal is poured into the upper mold and the lower mold from the ladle in a tilted manner, suction of air and an oxide film hardly occurs, thereby enabling quality of a casting to be improved.

In yet another embodiment, the pouring apparatus may start transferring the molten metal before the casting apparatus is ready to receive the molten metal. In this case, productivity is improved as compared with a case where the pouring apparatus transfers and pours the molten metal to the casting apparatus after the upper mold and the lower mold become the mold closed state or transition to the first separation state.

In yet another embodiment, the casting equipment may include a plurality of the casting apparatuses to be configured to allow the pouring apparatus to transfer and pour the molten metal to each of the plurality of casting apparatuses from the holding furnace. As described above, since each of the casting apparatuses is reduced in size, it is possible to arrange each of the casting apparatuses by reducing an interval between each other. Accordingly, a burden on the pouring apparatus can be reduced. For example, in a case where an operator operates in each of the casting apparatuses, such as a case where the operator fits a core, it is possible to reduce a burden on the operator who moves between each of the casting apparatuses.

In yet another embodiment, the pouring apparatus may include a receiving unit that receives a casting from the upper mold. After the upper mold and the lower mold are opened by the mold closing mechanism, the receiving unit may receive a casting from the upper mold when the lower mold is moved in the direction away from the pouring apparatus and the upper mold is moved in the direction approaching the pouring apparatus, by the drive means, to become a second separation state where the upper mold and the lower mold are horizontally separated from each other. In this case, since the pouring apparatus includes the receiving unit and also serves as receiving means, it is possible to further reduce a space occupied by the casting equipment as compared with a case where the receiving means is separately provided.

Advantageous Effects of Invention

A variety of aspects and embodiments of the present invention enable a space occupied by casting equipment to be reduced.

DESCRIPTION OF EMBODIMENTS

Figure 1:
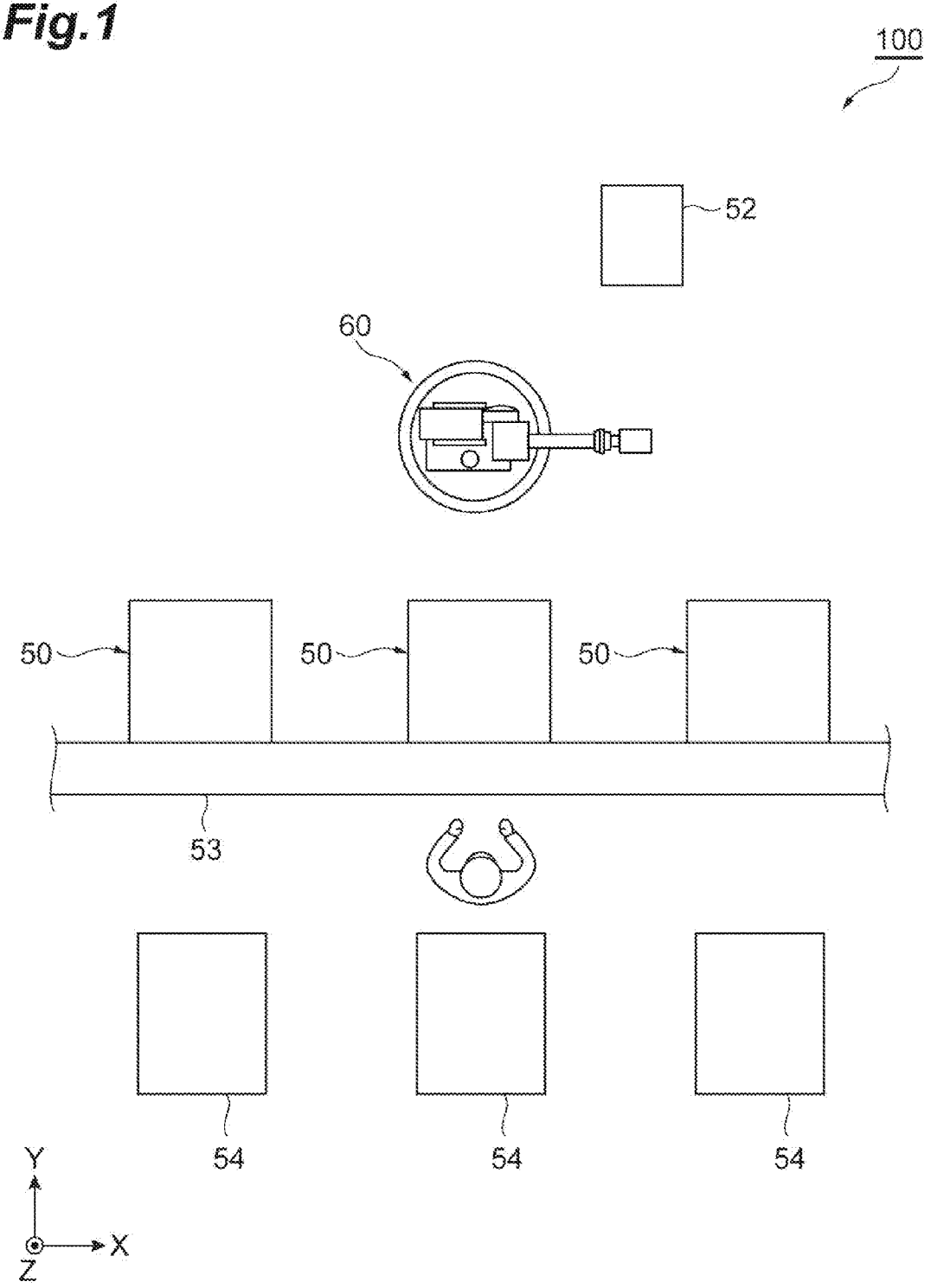
FIG. 1 is a plan view of casting equipment in accordance with a first embodiment.

Embodiments of the present invention will be described below with reference to the accompanying drawings. In description of the drawings, the same element is designated by the same reference numeral without duplicated description on the element. In addition, a dimension ratio of the drawings does not always agree with an actual ratio of a described matter. Further, each of terms of "upper", "lower", "left", and "right" is a state based on a state shown in the drawings, and is shown for convenience.

First Embodiment

Figure 2:
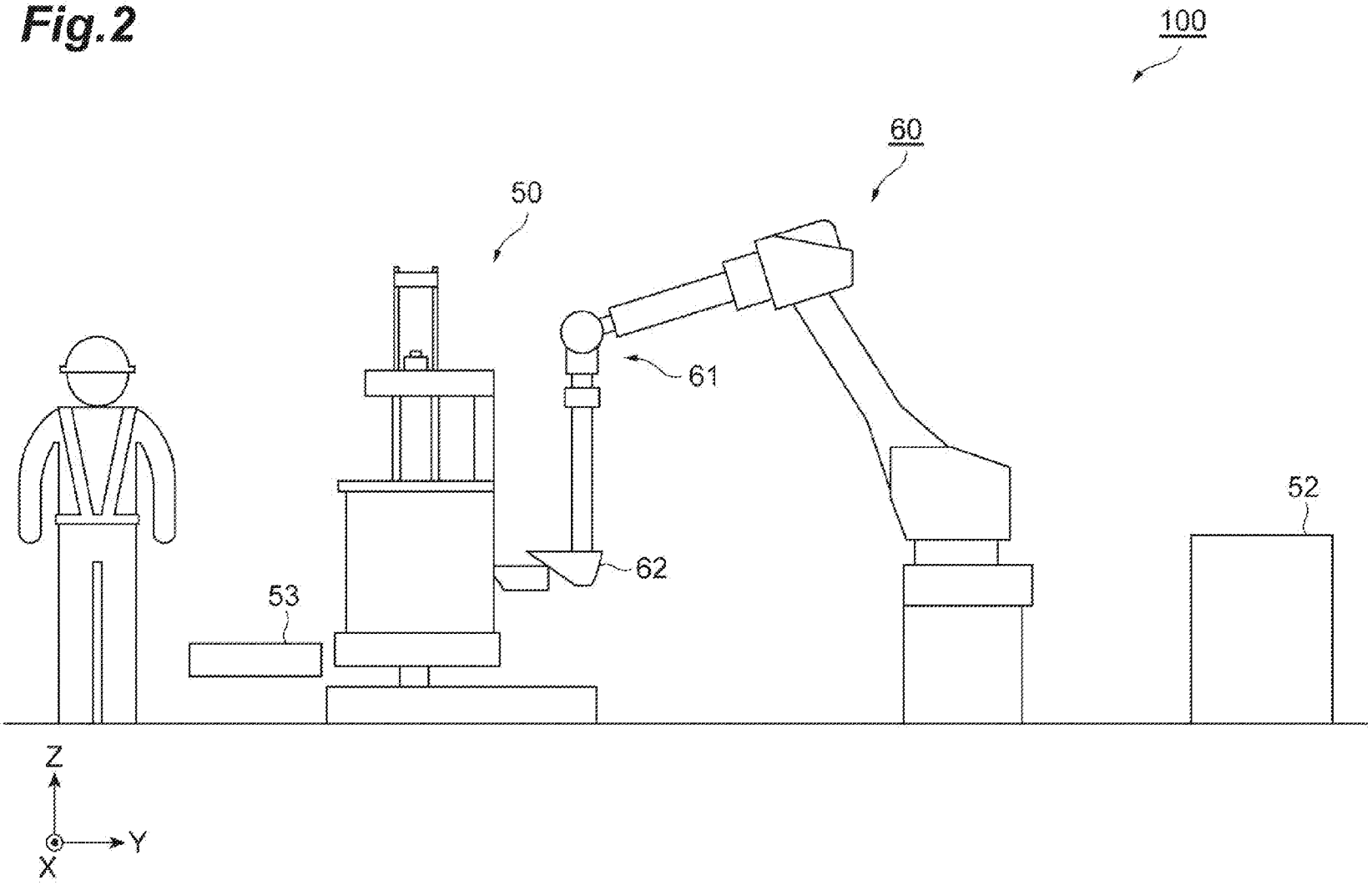
FIG. 2 is a side view of a part of the casting equipment shown in FIG. 1.

With reference to FIGS. 1 and 2, an example of casting equipment in accordance with the first embodiment will be described. FIG. 1 is a plan view of casting equipment in accordance with the first embodiment. FIG. 2 is a side view of a part of the casting equipment shown in FIG. 1. In FIGS. 1 and 2, each of an X direction and a Y direction is a horizontal direction, and a Z direction is a vertical direction. As shown in FIGS. 1 and 2, casting equipment 100 includes a casting apparatus 50, a holding furnace 52, a pouring apparatus (pouring robot) 60, a conveyor 53, and a core molding apparatus 54. The casting equipment 100 may not include the conveyor 53 and the core molding apparatus 54. The casting equipment 100 may include apparatuses (not shown) in upstream or downstream steps (such as a product cooler, a shakeout apparatus, and a product finishing apparatus).

In the present embodiment, the casting equipment 100 includes three casting apparatuses 50, for example. Each of the casting apparatuses 50 is horizontally (X direction) arranged in a line, for example. The pouring apparatus 60 is arranged at a position between the casting apparatus 50 and the holding furnace 52. The core molding apparatus 54 is arranged on the opposite side of the holding furnace 52 with respect to the casting apparatus 50. The casting equipment 100 includes three core molding apparatuses 54 corresponding to the respective three casting apparatuses 50, for example. A work space for an operator is provided in a space between the casting apparatus 50 and the core molding apparatus 54. In addition, the conveyor 53 is arranged in a space between the casting apparatus 50 and the core molding apparatus 54. The conveyor 53 is arranged in the X direction along arrangement of each of the casting apparatuses 50, for example. The conveyor 53 extends to an apparatus in a downstream step, for example.

The casting apparatus 50 is so-called a gravity tilting mold casting apparatus that forms a casting by using an upper mold 1 and a lower mold 2 (refer to FIG. 3), which can be opened, closed, and tilted, into which molten metal is poured by using gravity. Any material is available for the molten metal to be poured. For example, aluminum alloy, magnesium alloy, and the like are available for the molten metal. The casting apparatus 50 includes a controller described later to be able to control operation of each component. Details of the casting apparatus 50 will be described later.

The holding furnace 52 is an apparatus that stores molten metal to be used in the casting apparatus 50. The holding furnace 52 has a function of maintaining the molten metal at a prescribed temperature, for example. The holding furnace 52 may also have a function of a melting furnace for melting metal to form molten metal.

The pouring apparatus 60 is an apparatus that transfers and pours molten metal to the casting apparatus 50 from the holding furnace 52. In the present embodiment, the pouring apparatus 60 transfers and pours molten metal to each of the plurality of casting apparatuses 50 from the holding furnace 52. The pouring apparatus 60 is a robot provided with an arm 61 and a ladle 62, for example. The arm 61 has a multiple-joint structure, for example, and is capable of adopting a variety of postures in response to a signal from a controller described later. The ladle 62 is attached to a leading end of the arm 61. The arm 61 is operated to scoop molten metal in the holding furnace 52 with the ladle 62 so that the molten metal is transferred to the casting apparatus 50 to be poured into the casting apparatus 50.

The pouring apparatus 60 and the casting apparatus 50 are communicatively connected to each other. For example, the pouring apparatus 60 and the casting apparatus 50 are connected to a network, through which communication is performed according to a predetermined communication standard, to perform bidirectional transmission and reception of information.

The conveyor 53 is an apparatus for conveying a casting (a cast product) formed by the casting apparatus 50. The conveyor 53 is a belt conveyor, a slat conveyor, or the like, for example. The conveyor 53 conveys a casting, for example, to an apparatus in a downstream step.

The core molding apparatus 54 is an apparatus that injects core sand into a mold to form a core. The core molding apparatus 54 specifically includes a shell machine, a cold box molding machine, a cores and molding machine, and the like. A core formed by the core molding apparatus 54 is set at a predetermined position in the casting apparatus 50 by an operator arranged in the work space between the casting apparatus 50 and the core molding apparatus 54.

Figure 3:
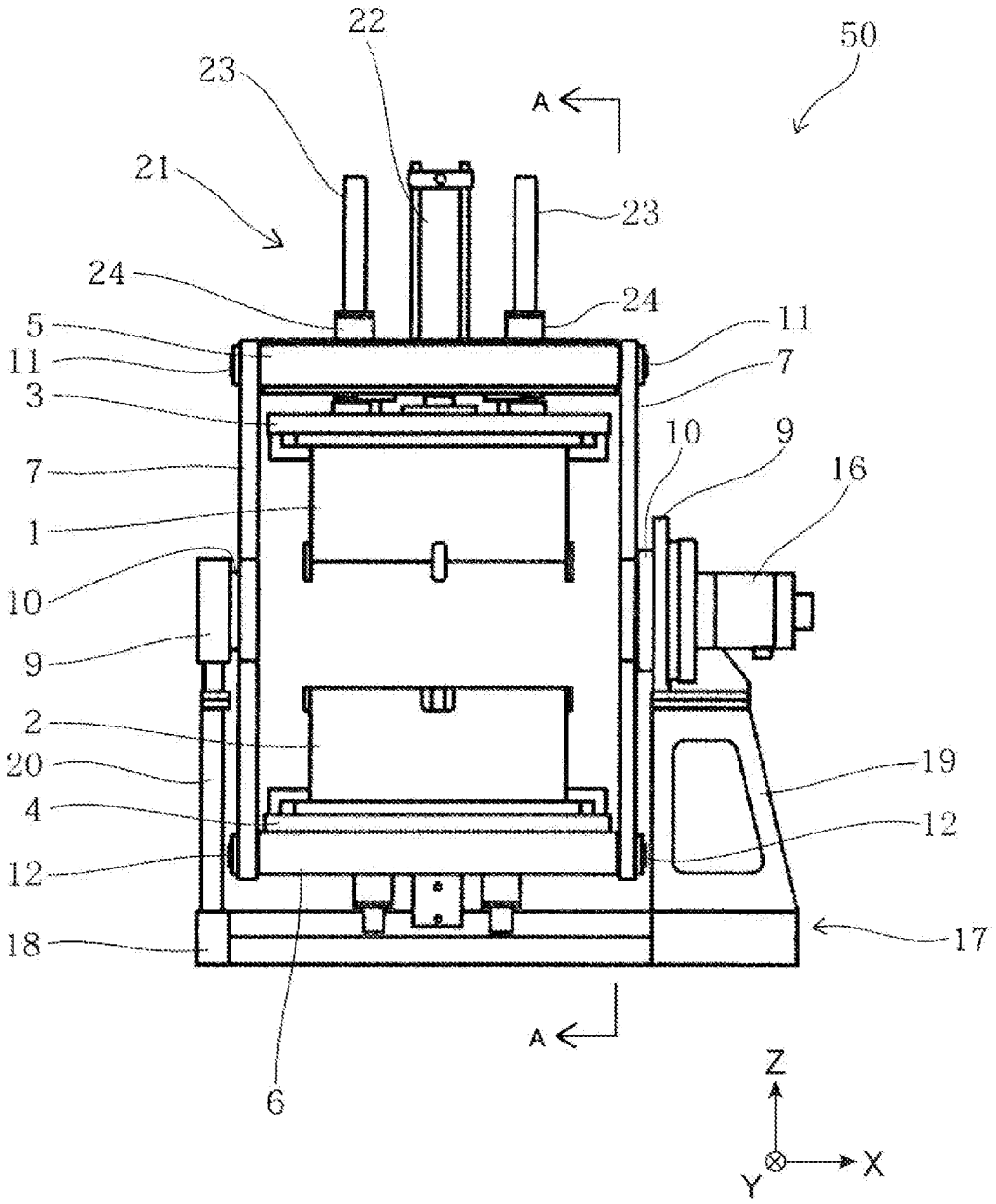
FIG. 3 is a front view of the casting apparatus shown in FIG. 1.
Figure 4:
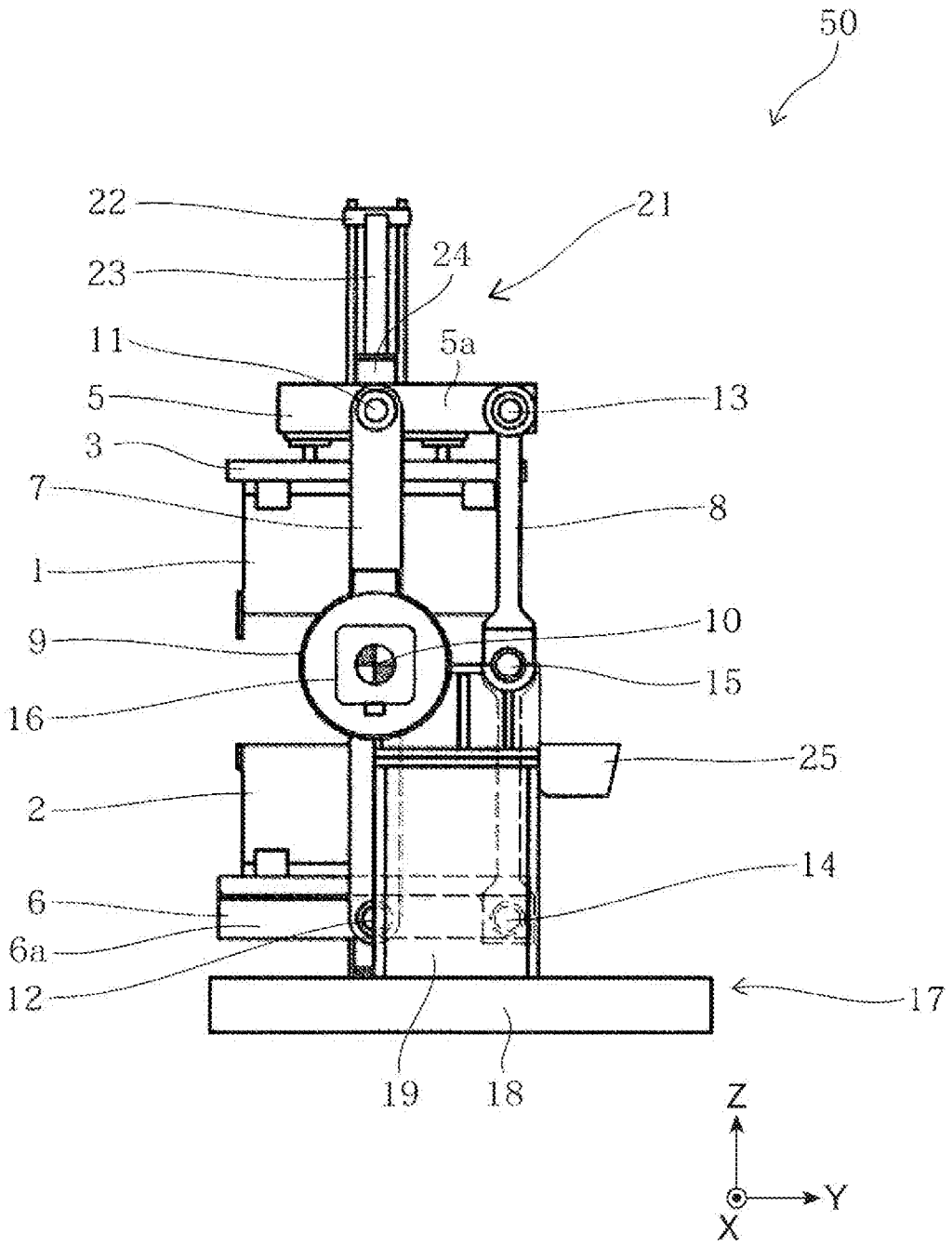
FIG. 4 is a side view of the casting apparatus shown in FIG. 3.

With reference to FIGS. 3 and 4, a structure of the casting apparatus 50 will be described. FIG. 3 is a front view of the casting apparatus shown in FIG. 1. FIG. 4 is a side view of the casting apparatus shown in FIG. 3.

As shown in FIGS. 3 and 4, the casting apparatus 50 includes a base frame 17, an upper frame 5, a lower frame 6, a mold closing mechanism 21, a left-and-right pair of main link members 7, a left-and-right pair sub-link members (auxiliary link members) 8, a rotation actuator (drive means) 16, and a ladle 25.

The base frame 17 includes a base 18, a drive side support frame 19, and a driven side support frame 20. The base 18 is a substantially plate-like member composed of a combination of a plurality of members, and is horizontally provided on an installation surface of the casting equipment 100. The drive side support frame 19 and the driven side support frame 20 are erected on the base 18 so as to face each other in a lateral direction (horizontal direction), and are fixed to the base 18. One of a pair of tilt rotation bearings 9 is provided in an upper end of the drive side support frame 19 and an upper end of the driven side support frame 20.

The upper frame 5 is arranged above the base frame 17. The upper mold 1 is attached to the upper frame 5. Specifically, the upper mold 1 is attached to a lower face of the upper frame 5 through an upper mold die base 3. The mold closing mechanism 21 for moving the upper mold 1 up and down is provided in the upper frame. Specifically, the upper frame 5 has the mold closing mechanism 21 built in, and the upper mold 1 is held by the mold closing mechanism 21 so as to be able to move up and down.

The mold closing mechanism 21 includes a mold closing cylinder 22, a left-and-right pair of guide rods 23, and a left-and-right pair of guide cylinders 24. The lower end of the mold closing cylinder 22 is attached to an upper face of the upper mold die base 3. The mold closing cylinder 22 is extended in an up-and-down direction (a vertical direction, here the Z direction) to lower the upper mold 1 through the upper mold die base 3, as well as is shortened in the up-and-down direction to raise the upper mold 1 through the upper mold die base 3. The guide rod 23 is attached to an upper face of the upper mold die base 3 through the guide cylinder 24 attached to the upper frame 5.

The lower frame 6 is arranged above the base frame 17 and below the upper frame 5. The lower mold 2 is attached to the lower frame 6. Specifically, the lower mold 2 is attached to an upper face of the lower frame 6 through a lower mold die base 4. In a state shown in each of FIGS. 3 and 4, the upper frame 5 and the lower frame 6 face each other in the up-and-down direction. Likewise, the upper mold 1 and the lower mold 2 face each other in the up-and-down direction.

Each of the pair of main link members 7 has upper and lower ends that are rotatably coupled to the upper frame 5 and the lower frame 6, respectively, to be oppositely arranged, and has a central portion provided with a tilt rotating shaft 10. Specifically, the pair of main link members 7 is oppositely arranged in the lateral direction (the horizontal direction, here the X direction), and each of the main link members 7 couples the upper frame 5 and the lower frame 6 to each other. The main link member 7 is provided with the tilt rotating shaft 10 at its central portion, a main link upper rotating shaft 11 at its upper end, and a main link lower rotating shaft 12 at its lower end.

The central portion of each of the pair of main link members 7 is rotatably coupled to one of the pair of tilt rotation bearings 9 through one of the pair of tilt rotating shafts 10. The upper end of each of the pair of main link members 7 is rotatably coupled to one of a pair of side faces 5*a* of the upper frame 5 through one of the pair of main link upper rotating shafts 11. The lower end of each of the pair of main link members 7 is rotatably coupled to one of a pair of side faces 6*a* of the lower frame 6 through one of the pair of main link lower rotating shafts 12. Attachment positions of the main link member 7 to the upper frame 5 and the lower frame 6 are set so that the main link member 7 is positioned at the center of each of the upper mold 1 and the lower mold 2 in a depth direction (Y direction) orthogonal to the lateral direction and the up-and-down direction when the upper mold 1 and the lower mold 2 are closed.

Each of the pair of sub-link members 8 is arranged parallel to one of the main link members 7. The sub-link member has upper and lower ends that are rotatably coupled to the upper frame 5 and the lower frame 6, respectively, to be oppositely arranged. The sub-link member has a central portion provided with a sub-link central portion rotating shaft 15. Specifically, the pair of sub-link members 8 is oppositely arranged in the lateral direction to couple the upper frame 5 and the lower frame 6 to each other. Each of the pair of sub-link members 8 is provided with one of a pair of sub-link upper rotating shafts 13 at its upper, one of a pair of sub-link lower rotating shafts 14 at its lower ends, and one of a pair of sub-link central portion rotating shafts 15 at its central portion. Each of the pair of sub-link members 8 is provided in one of the pair of side faces 5*a* and one of the pair of side faces 6*a* so as to be parallel to one of the pair of main link members 7. Length of the sub-link member 8 is the same as length of the main link member 7. The upper frame 5, the lower frame 6, the main link member 7, and the sub-link member 8, constitute a parallel link mechanism.

Each of the upper ends of the pair of sub-link members 8 is rotatably coupled to one of the pair of side faces 5*a* of the upper frame 5 through one of the pair of sub-link upper rotating shafts 13. The lower end of the sub-link member 8 is rotatably coupled to one of the pair of side faces 6*a* of the lower frame 6 through one the pair of sub-link lower rotating shafts 14. An attachment position of the sub-link member 8 is on a side, where the ladle 25 is arranged, with respect to the main link member 7. In a state of FIGS. 3 and 4, the sub-link central portion rotating shaft 15 is mounted on an upper face of the drive side support frame 19.

A rotation actuator 16 is arranged above the drive side support frame 19. The rotation actuator 16 is provided to be coupled to the tilt rotating shaft 10 of one of the pair of main link members 7. The rotation actuator 16 serves as the drive means that tilts the upper mold 1 and the lower mold 2, or that allows the molds to separate from each other in the horizontal direction. The rotation actuator 16 may be any one of electrically-operated, hydraulically-operated, and pneumatically-operated.

In this way, the upper frame 5, the lower frame 6, the main link member 7, and the sub-link member 8, constitute the parallel link mechanism, and the tilt rotating shaft 10 of the main link member 7 is held in the base frame 17 outside a left-and-right pair of parallel link mechanisms by a tilt rotation bearing 9. Then, the sub-link central portion rotating shaft 15 of the sub-link member 8 is mounted on the base frame 17, and the rotation actuator 16 is attached to the tilt rotating shaft 10 of one of the main link members 7.

The ladle 25 is attached to an upper end of a side face of the lower mold 2, the side face facing the pouring apparatus 60. The ladle 25 includes a storage section that is formed thereinside to store molten metal, and a pouring port 25*a* (refer to FIG. 8) that is connected to a receiving port 2*a* (refer to FIG. 8) of the lower mold 2.

Figure 5:
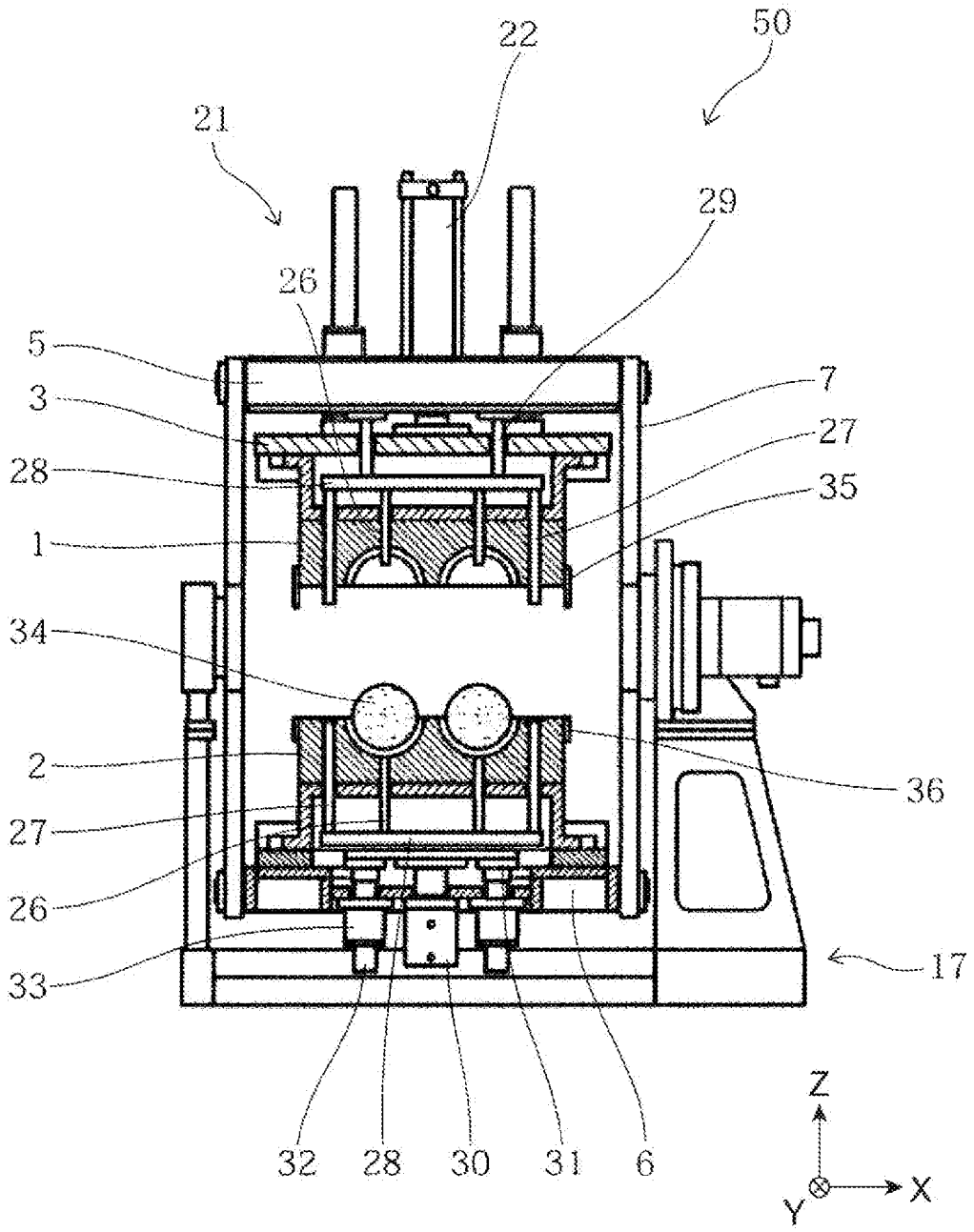
FIG. 5 shows a section of the upper mold and the lower, mold shown in FIG. 3.

FIG. 5 shows a section of the upper mold and the lower mold shown in FIG. 3. Here, there is shown a state where a plurality of cores 34 are fitted in an upper face of the lower mold 2. As shown in FIG. 5, the upper mold 1 includes a built-in pushing out plate 28 to which a pair of pushing out pins 26 and a pair of return pins 27 are coupled. The upper frame 5 is provided in its lower face with a plurality of push rods 29 that penetrates the upper mold die base 3. Length of the push rod 29 is set so that the push rod 29 pushes down the pushing out plate 28 when the mold closing cylinder 22 is shortened to allow the upper mold 1 to reach an ascending end. The ascending end is the highest position of the upper mold 1 that can be obtained by shortening the mold closing cylinder 22.

The lower frame 6 includes a built-in pushing out cylinder 30. An upper end of the pushing out cylinder 30 is attached to a lower face of a pushing out member 31. A left-and-right pair of guide rods 32 is attached to the lower face of the pushing out member 31 through a guide cylinder 33 attached to the lower frame 6.

As with the upper mold 1, the lower mold 2 includes the built-in pushing out plate 28 to which the pair of pushing out pins 26 and the pair of return pins 27 are coupled. In the lower mold 2, there is a positional relationship in which the pushing out member 31 is raised by elongating action of the pushing out cylinder 30 to push up the pushing out plate 28, thereby allowing the pair of pushing out pins 26 and of return pins 27 to rise. The return pins 27 of the upper mold 1 and the lower mold 2 are pushed back when the molds are closed because their leading ends are pushed back by a mating face of the opposite mold or by leading ends of opposite return pins 27. Accordingly, the pushing out pins 26 coupled to the pushing out plate 28 are also pushed back. In addition, when the molds are closed, the pushing out member 31 reaches a descending end position by shortening action of the pushing out cylinder 30. The descending end is the lowest position of the lower mold 2 that can be obtained by shortening the pushing out cylinder 30.

A pair of positioning keys 35 is attached to the periphery of a lower portion of the upper mold 1. A pair of positioning key grooves 36 is attached to the periphery of an upper portion of the lower mold 2 according to the pair of positioning keys 35. When the upper mold 1 and the lower mold 2 are closed, the positioning key 35 is fitted into the positioning key groove 36. Since the positioning keys 35 and the positioning key grooves 36 allow the upper mold 1 and the lower mold 2 to be positioned in the horizontal direction, it is possible to prevent the upper mold 1 and the lower mold 2 from being displaced from each other when closed.

Figure 6:
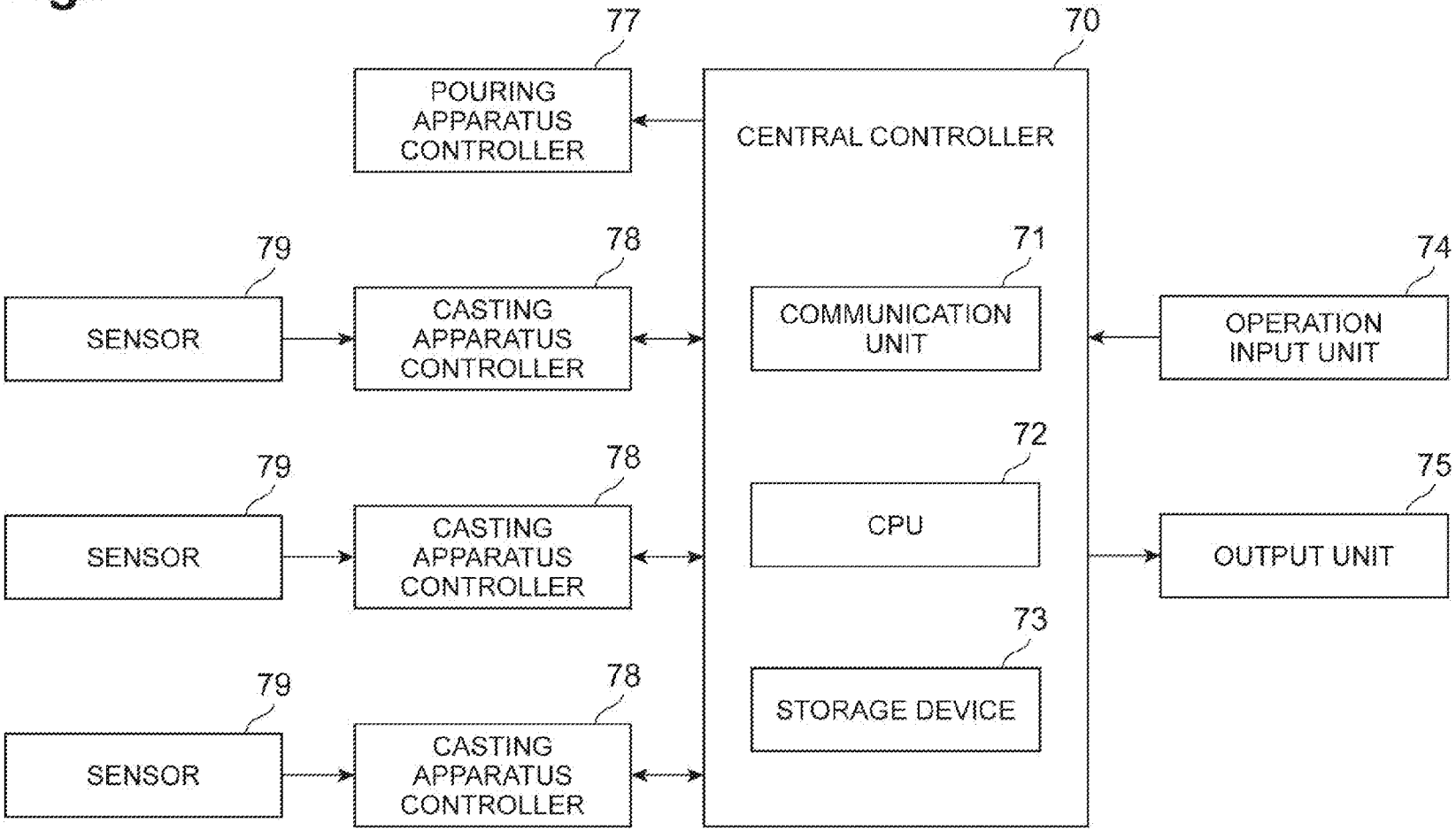
FIG. 6 is a functional block diagram of the casting equipment of FIG. 1.

FIG. 6 is a functional block diagram of the casting equipment of FIG. 1. As shown in FIG. 6, the casting equipment 100 includes a central controller 70, an operation input unit 74, an output unit 75, a pouring apparatus controller 77, a casting apparatus controller 78, and a sensor 79. The central controller 70, the pouring apparatus controller 77, and the casting apparatus controller 78, are connected to a network, such as a local area network (LAN), to enable bidirectional communication.

The central controller 70 controls the whole operation of the casting equipment 100. The central controller 70, for example, includes a communication unit 71, a central processing unit (CPU) 72, and a storage device 73.

The communication unit 71 enables communication through the network connected. The communication unit 71 is a communication device, such as a network card, for example. The communication unit 71 receives information from the operation input unit 74 and the casting apparatus controller 78, as well as transmits information to the output unit 75, the pouring apparatus controller 77, and the casting apparatus controller 78. The CPU 72 controls operation of the central controller 70. The storage device 73 includes a read only memory (ROM), a random access memory (RAM), and a hard disk, for example.

The operation input unit 74 is an input device, such as a keyboard, for example. The output unit 75 is an output device, such as a display, for example.

The pouring apparatus controller 77 controls operation of the pouring apparatus 60. The pouring apparatus controller 77 includes a communication unit, a CPU, and a storage device, which are not shown. The storage device provided in the pouring apparatus controller 77 stores jobs that define postures for, such as scooping operation, transferring operation, and pouring operation, for example. The CPU of the pouring apparatus controller 77 executes the jobs to control the postures of the arm 61. The pouring apparatus controller 77 indirectly or directly communicates with the casting apparatus controller 78 through the central controller 70. The pouring apparatus controller 77 may be configured to be able to detect the postures of the arm 61 by using a sensor (not shown). The pouring apparatus controller 77 may transmit information on the postures of the arm 61 to the central controller 70.

The casting apparatus controller 78 controls operation of the casting apparatus 50. The casting apparatus controller 78 includes a communication unit, a CPU, and a storage device, which are not shown. The casting apparatus controller 78 and the sensor 79 are provided for each of the casting apparatuses 50, for example. The storage device provided in the casting apparatus controller 78 stores jobs that define postures for, such as a mold closed state, an initial state, a first separation state, a second separation state, or the like, which will be described later, for example. The CPU of the casting apparatus controller 78 executes the jobs to control the postures of the casting apparatus 50. The sensor 79 detects a state of each of the upper mold 1 and the lower mold 2 in the casting apparatus 50 to transmit information showing the state of each of the upper mold 1 and the lower mold 2 to the casting apparatus controller 78. Specifically, the sensor 79 detects whether the upper mold 1 and the lower mold 2 are in the mold closed state, the initial state, the first separation state, the second separation state, or the like, which will be described later, to transmit information showing any one of the states to the casting apparatus controller 78.

The casting apparatus controller 78 indirectly or directly communicates with the pouring apparatus controller 77 through the central controller 70. For example, the casting apparatus controller 78 transmits information showing whether the casting apparatus 50 is in the mold closed state, the initial state, the first separation state, the second separation state, or the like, which will be described later, to the pouring apparatus controller 77.

The configuration described above enables the pouring apparatus controller 77 and the casting apparatus controller 78 to exchange information with each other according to control by the central controller 70 (or without intervention of the central controller 70) to form a casting in cooperation with each other. The central controller 70 is capable of storing operation information on the casting equipment 100 and the like in the storage device 73. The central controller 70 receives operation inputted into the operation input unit 74 by an administrator, and then outputs information corresponding to the operation to the output unit 75. In addition, a component (not shown) may be connected to the network. For example, a controller (not shown) of the core molding apparatus 54 may be connected to the network to be able to communicate with the central controller 70 or the like.

Figure 7:
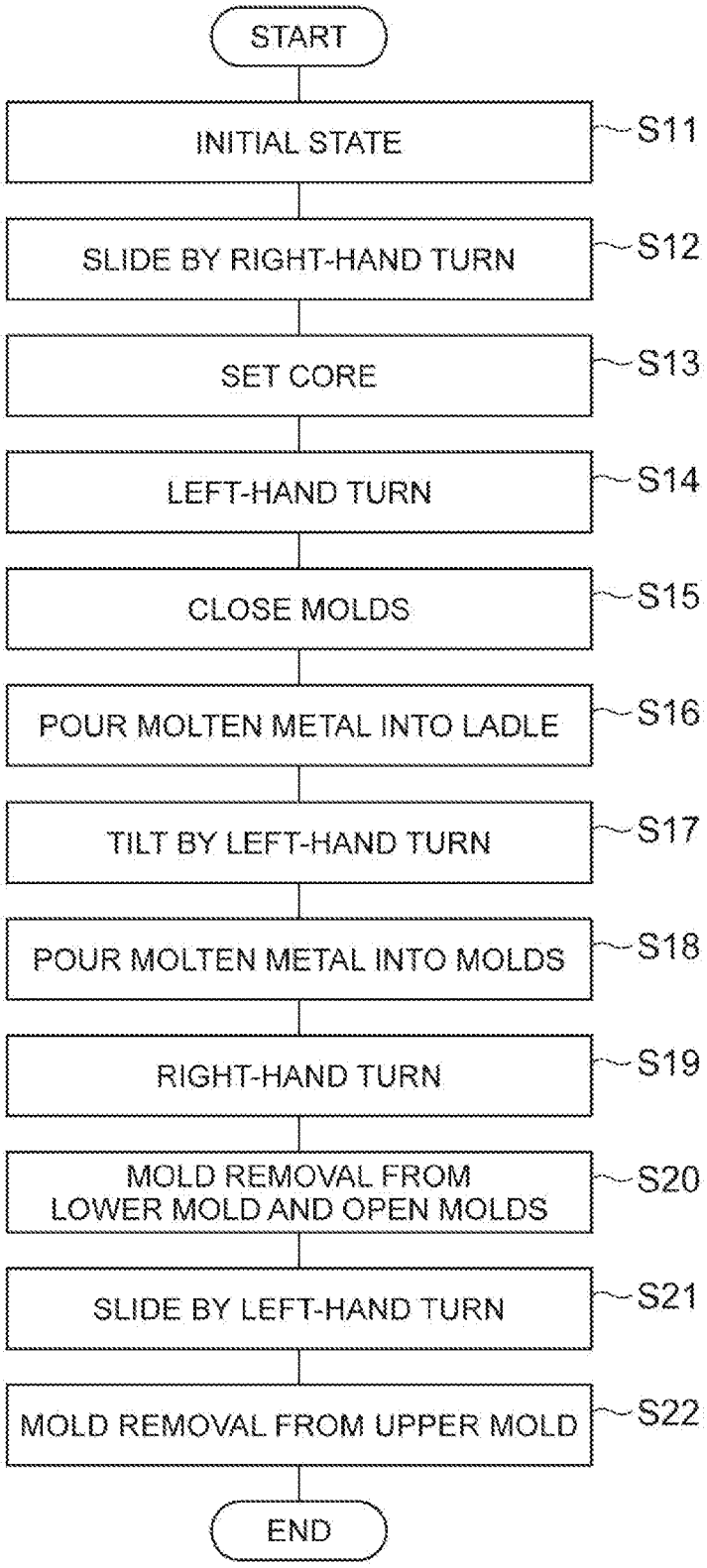
FIG. 7 is a flow chart showing a casting method using the casting equipment of FIG. 1.
Figure 8:
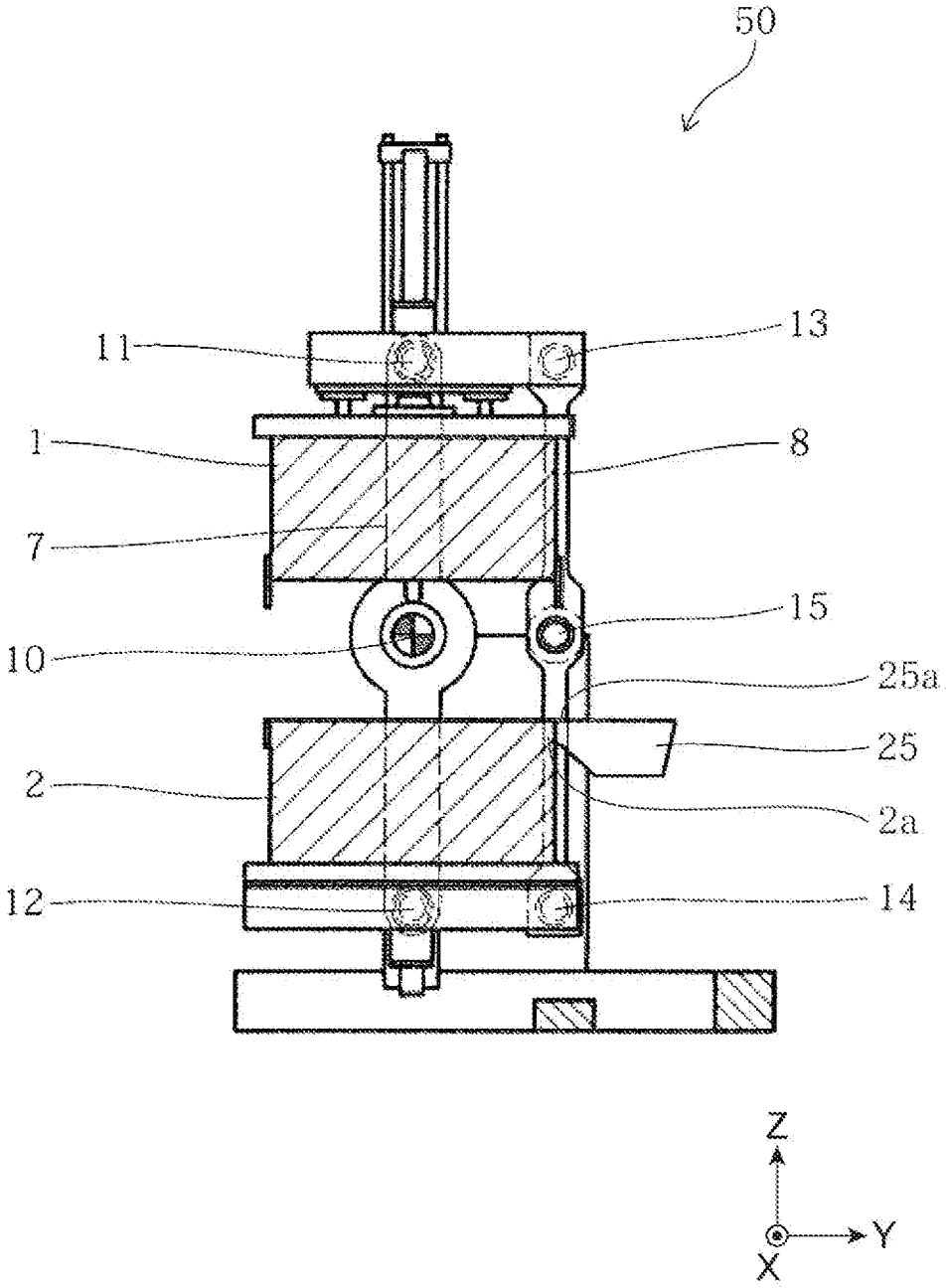
FIG. 8 is an illustration viewed from arrows A-A in FIG. 3 to describe an initial state.
Figure 9:
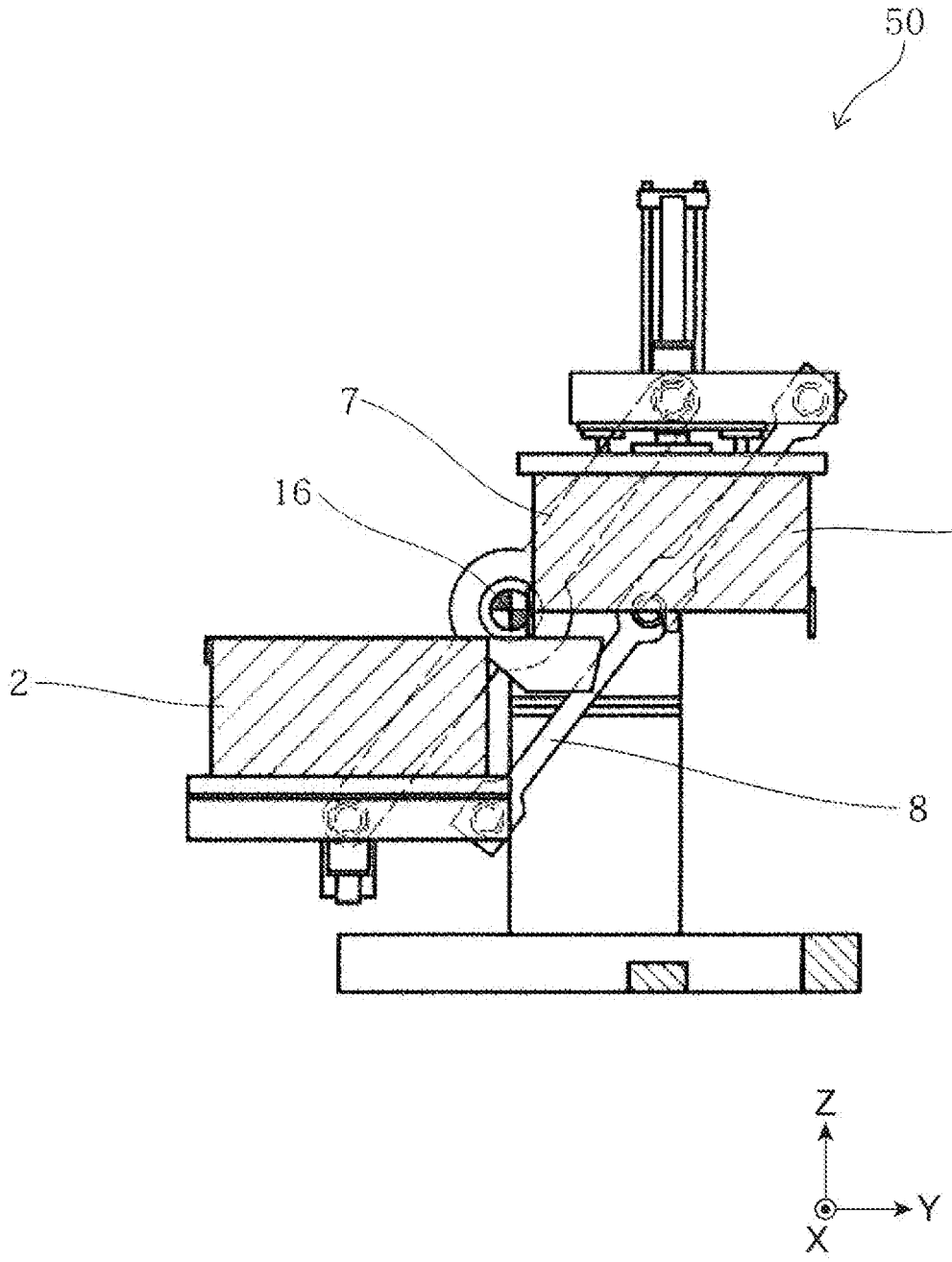
FIG. 9 shows the second separation state after the upper and lower molds are slid by operation of a parallel link mechanism.
Figure 10:
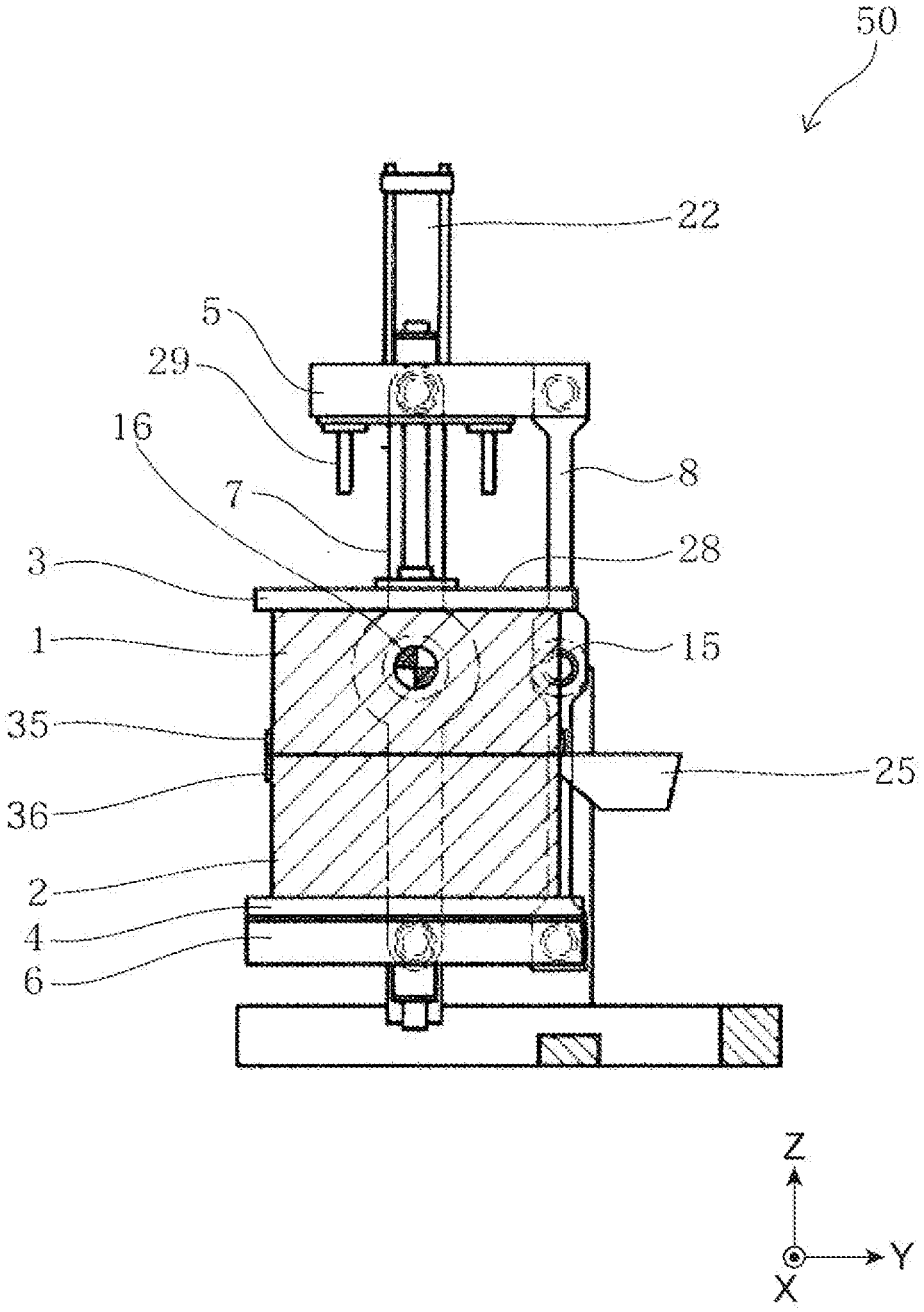
FIG. 10 is an illustration to describe a mold closing state where the upper mold and the lower mold are closed.
Figure 11:
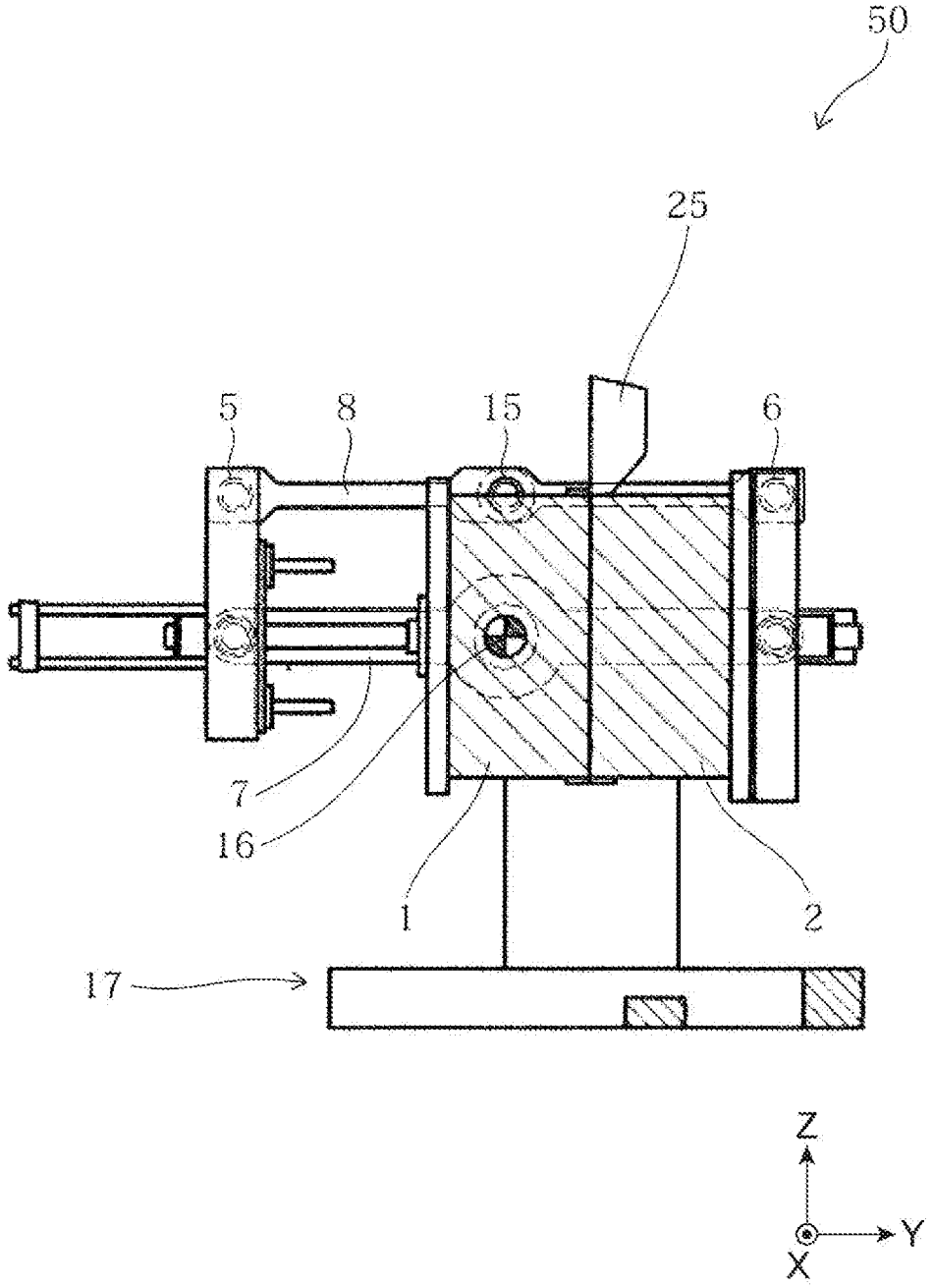
FIG. 11 shows the upper mold and the lower mold closed that are turned at 90°.
Figure 12:
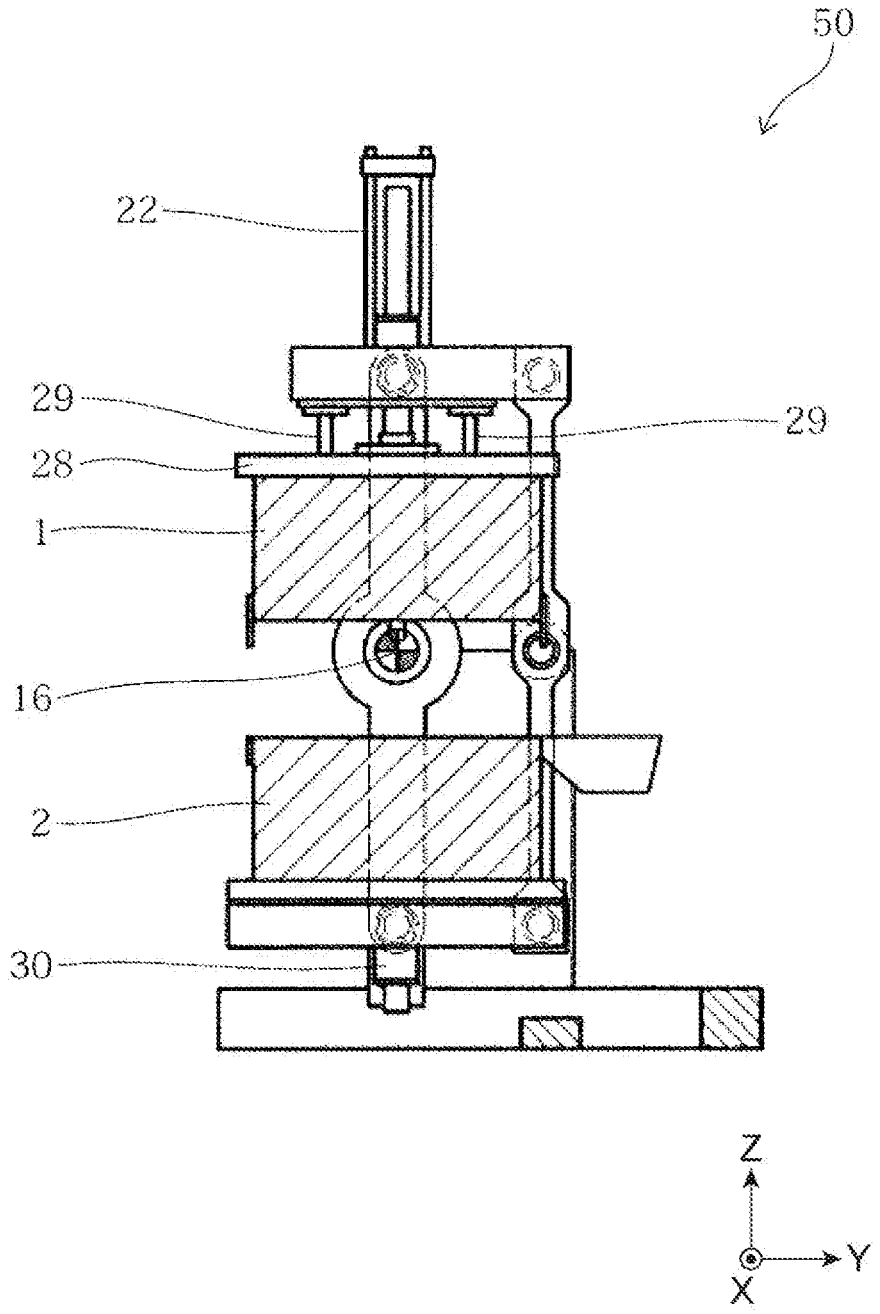
FIG. 12 shows the upper mold that is lifted up to an intermediate position.
Figure 13:
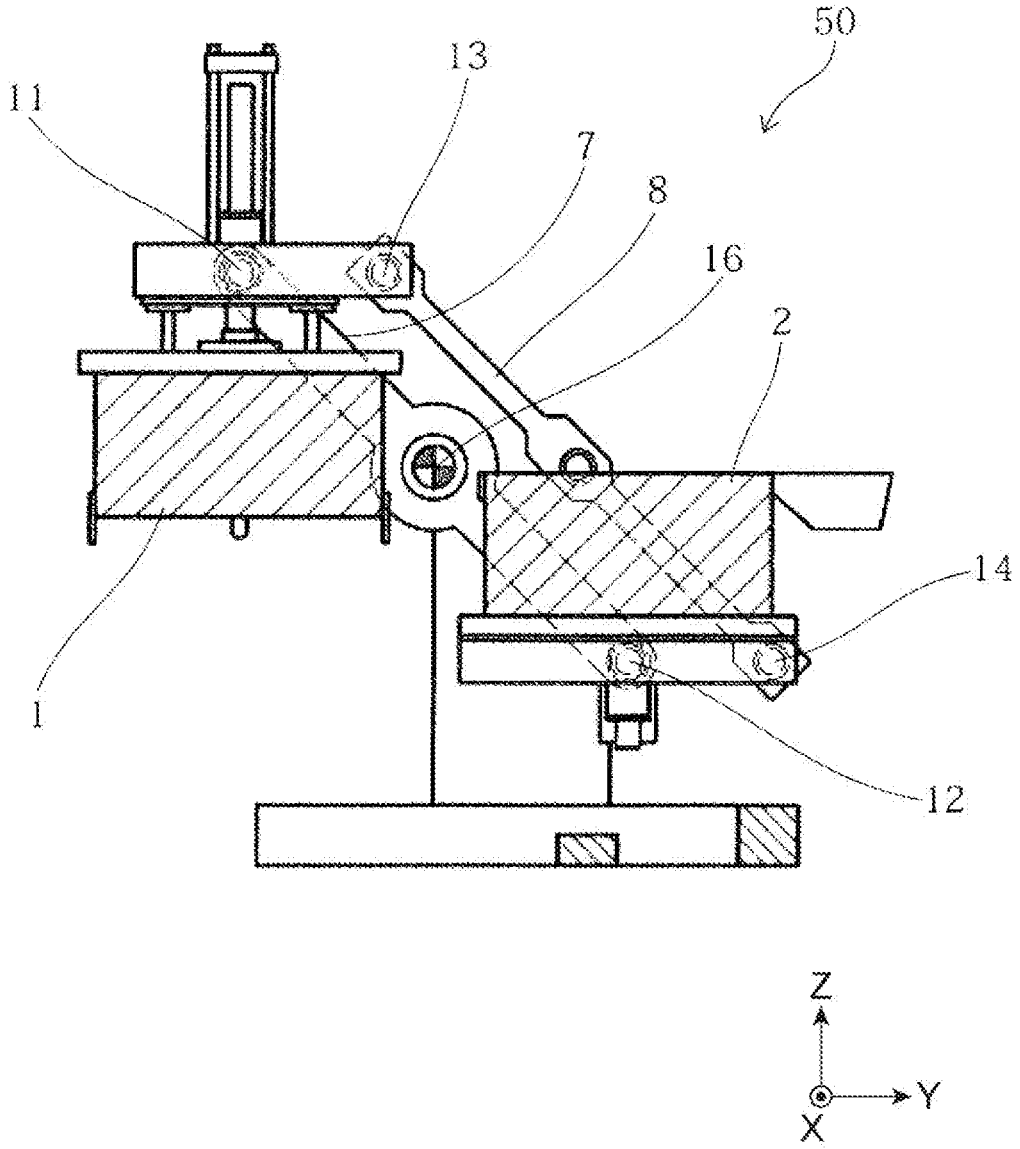
FIG. 13 shows a first separation state after the upper mold and the lower mold are slid.
Figure 14:
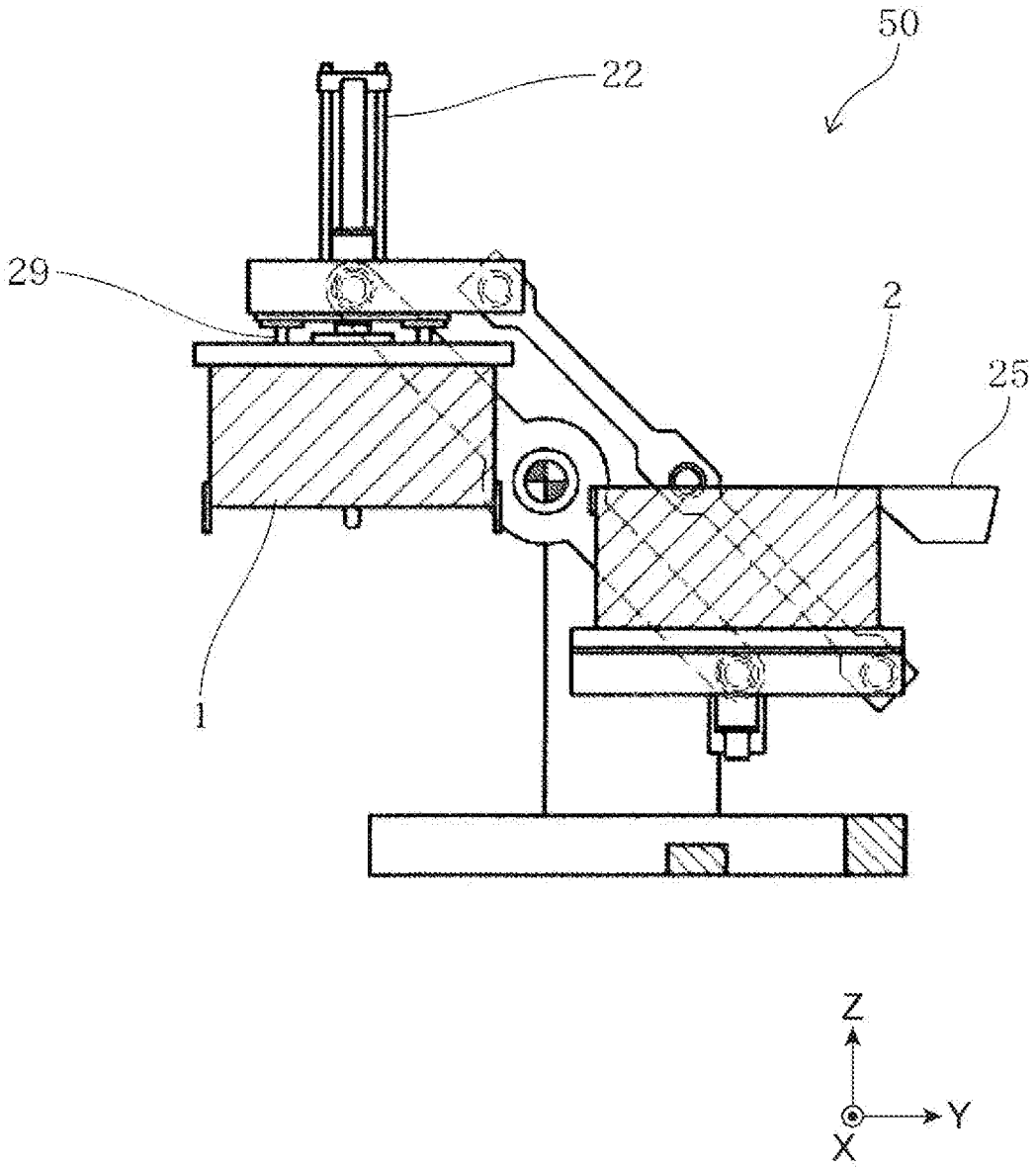
FIG. 14 shows a state where the upper mold is lifted up to an ascending end from the state of FIG. 13.

With reference to FIGS. 7 to 14, an example of a casting method using the casting equipment 100 will be described. FIG. 7 is a flow chart showing an example of the casting method using the casting equipment. FIG. 8 is an illustration viewed from arrows A-A in FIG. 3 to describe the initial state. FIG. 9 shows the second separation state after the upper and lower molds are slid by operation of a parallel link mechanism. FIG. 10 is an illustration to describe the mold closed state where the upper mold and the lower mold are closed. FIG. 11 shows the upper mold and the lower mold closed that are turned at 90°. FIG. 12 shows the upper mold that is lifted up to an intermediate position. FIG. 13 shows the first separation state after the upper mold and the lower mold are slid. FIG. 14 shows a state where the upper mold is lifted up to the ascending end from the state of FIG. 13.

As shown in FIGS. 7 and 8, first, the casting apparatus 50 is set in the initial state of a series of casting steps (S11). In the initial state, the upper mold 1 is positioned at the ascending end, and the pair of main link members 7 and the pair of sub-link members 8 are perpendicular to an installation surface of the casting equipment 100.

Subsequently, as shown in FIGS. 7 and 9, the casting apparatus 50 allows the rotation actuator 16 to turn clockwise. In the present embodiment, a clockwise turn is a right-hand turn, and a reverse turn is a left-hand turn. Accordingly, each of the upper mold 1 and the lower mold 2 slides in a direction opposite to each other along an arc by operation of the parallel link mechanism (S12). Specifically, the upper mold 1 and the lower mold 2, facing each other, move around the tilt rotating shaft 10 as a center axis in a circular motion of the right-hand turn so that the upper mold 1 and the lower mold 2 move so as to separate from each other in the horizontal direction. Then, the upper mold 1 moves toward the pouring apparatus 60 (refer to FIG. 1) to become the second separation state. In the present embodiment, a state where the lower mold 2 moves toward the pouring apparatus 60 is indicated as the first separation state, and a state where the upper mold 1 moves toward the pouring apparatus 60 is indicated as the second separation state. That is, the first separation state (refer to FIG. 13) is a state where the rotation actuator 16 moves the upper mold 1 in a direction away from the pouring apparatus 60 as well as the lower mold 2 in a direction approaching the pouring apparatus 60 to allow the upper mold 1 and the lower mold 2 to separate from each other in the horizontal direction. The second separation state (refer to FIG. 9) is a state where the rotation actuator 16 moves the upper mold 1 in the direction approaching the pouring apparatus 60 as well as the lower mold 2 in the direction away from the pouring apparatus 60 to allow the upper mold 1 and the lower mold 2 to separate from each other in the horizontal direction.

Next, the core 34 molded by the core molding apparatus 54 is fitted in a prescribed position in the lower mold 2 (S13). Operation of fitting the core 34 is performed by an operator, for example. In the second separation state, a space above the lower mold 2 is opened as well as the ladle 25 attached to the lower mold 2 is not brought into contact with the upper mold 1. In this manner, since the space above the lower mold 2 is opened, it is possible to fit a core in the lower mold 2 in safety.

Subsequently, the casting apparatus 50 allows the rotation actuator 16 to perform the left-hand turn so that the casting apparatus 50 temporarily returns to the initial state of FIG. 8 (S14). Next, as shown in FIGS. 7 and 10, the casting apparatus 50 allows the mold closing cylinder 22 to elongate to close the upper mold 1 and the lower mold 2 (S15). Then, the positioning key 35 of the upper mold 1 and the positioning key groove 36 of the lower mold 2 are fitted with each other to fix the upper mold 1 and the lower mold 2. In addition, the molds are closed not to allow the main link member 7, the sub-link member 8, the main link upper rotating shaft 11, the main link lower rotating shaft 12, the sub-link upper rotating shaft 13, and the sub-link lower rotating shaft 14, to turn, whereby the upper mold 1, the lower mold 2, the upper frame 5, the lower frame 6, the main link member 7, and the sub-link member 8, are integrated.

Next, when the upper mold 1 and the lower mold 2 are closed to become the mold closed state, the pouring apparatus 60 (refer to FIG. 1) supplies molten metal to the ladle 25 (S16). Specifically, in step S14 described above, when the upper mold 1 and the lower mold 2 return to the initial state of FIG. 8, the pouring apparatus 60 transfers molten metal to the casting apparatus 50 from the holding furnace 52 (refer to FIG. 2). That is, the pouring apparatus 60 scoops molten metal in the holding furnace 52 with the ladle 62 (refer to FIG. 2), and moves the ladle 62 to a position at which the molten metal can be poured into the ladle 25 to prepare pouring. After that, in step S16 described above, when the upper mold 1 and the lower mold 2 become the mold closed state, the pouring apparatus 60 pours the molten metal in the ladle 62 into the ladle 25. In this way, the pouring apparatus 60 starts transferring the molten metal before the casting apparatus 50 is ready to receive the molten metal.

In a case where the upper mold 1 and the lower mold 2 are in the mold closed state, the casting apparatus 50 outputs information showing the mold closed state to the pouring apparatus 60. The pouring apparatus 60 does not pour the molten metal into the ladle 25 when receiving no information from the casting apparatus 50. Accordingly, even if there is a malfunction or a misoperation of the apparatus, a procedure, in which the pouring apparatus 60 pours the molten metal in a state (posture) where the casting apparatus 50 is ready to receive the molten metal, is obeyed. This kind of so-called interlock function is realized with cooperation of the sensor 79, the casting apparatus controller 78, the central controller 70, and the pouring apparatus controller 77. The interlock function may be realized without intervention of the central controller 70.

Subsequently, as shown in FIGS. 7 and 11, the casting apparatus 50 allows the rotation actuator 16 to perform the left-hand turn at approximately 90° to allow the upper mold 1 and the lower mold 2 to become a tilt state (S17). Accordingly, the sub-link central portion rotating shaft 15 is lifted up from an upper face of the base frame 17, on which the sub-link central portion rotating shaft 15 is mounted. As a result, the upper mold 1, the lower mold 2, the upper frame 5, the lower frame 6, the main link member 7, and the sub-link member 8, integrated after the molds are closed, are turned to tilt the ladle 25 to pour the molten metal in the ladle 25 into a cavity formed between the upper mold 1 and the lower mold 2 (S18).

After the step S18 described above is finished, a state of FIG. 11 is held for a prescribed time to wait for coagulation of the molten metal poured. As described above, although the rotation actuator 16 performs the left-hand turn at approximately 90° here, the rotation actuator 16 may be turned at a required angle within a range from 45° to 130° (preferably 45° to 90°).

Subsequently, the rotation actuator 16 is allowed to perform the right-hand turn so that the casting apparatus 50 temporarily returns to the state of FIG. 11 (S19). Next, mold removal from the lower mold 2 and mold opening are performed in parallel (S20). Mold opening is performed as shown in FIGS. 7 and 12, and simultaneously the mold removal from the lower mold 2 is also performed. Mold opening is started when the casting apparatus 50 operates the mold closing cylinder 22. Specifically, the casting apparatus 50 allows the mold closing cylinder 22 to be shortened to raise the upper mold 1, thereby starting mold opening of the upper mold 1 and the lower mold 2. Then, elongation of the pushing out cylinder 30 is started simultaneously with shortening action of the mold closing cylinder 22. The pushing out cylinder 30 is elongated to push out the pushing out pin 26 (refer to FIG. 5) built in the lower mold 2. Accordingly, a casting (not shown) formed by coagulation of the molten metal in the upper mold 1 and the lower mold 2 is removed from the lower mold 2 to be held in the upper mold 1. Then, the casting apparatus 50 raises the upper mold 1 to a prescribed position to complete mold opening. The prescribed position is a position where a leading end of the push rod 29 and an upper face of the pushing out plate 28 of the upper mold 1 are not brought into contact with each other. In other words, the prescribed position is a position where there is a clearance between the leading end of the push rod 29 and the upper face of the pushing out plate 28 of the upper mold 1.

Next, as shown in FIGS. 7 and 13, the casting apparatus 50 allows the rotation actuator 16 to perform the left-hand turn (S21). Accordingly, the casting apparatus 50 allows the upper mold 1 and the lower mold 2 to slide along an arc by operation of the parallel link mechanism to separate from each other in the horizontal direction. Then, the upper mold 1 moves toward the conveyor 53 (refer to FIG. 2), or the lower mold 2 moves in a direction approaching the pouring apparatus 60 (refer to FIG. 1), to become the first separation state. An angle of the left-hand turn of the rotation actuator 16 at the time is approximately 30° to 45° at which a space below the upper mold 1 is opened.

Subsequently, as shown in FIGS. 7 and 14, the casting apparatus 50 allows the mold closing cylinder 22 to be shortened to raise the upper mold 1 to the ascending end. Accordingly, the leading end of the push rod 29 pushes out the pushing out pin 26 (refer to FIG. 5) relatively with respect to the upper mold 1 through the pushing out plate 28 built in the upper mold 1. As a result, a casting held in the upper mold 1 is removed from the upper mold 1 (S22). The casting removed from the upper mold 1 drops to be received on the conveyor 53 (refer to FIG. 2) provided below the upper mold 1. After that, the casting is conveyed to, for example, the product cooler, the shakeout apparatus, the product finishing apparatus that removes burrs, and the like, by the conveyor 53. As described above, the series of casting steps is completed, and then the casting is formed by the casting equipment 100. In addition, when the casting steps above are repeated, it is possible to continuously form castings.

At the time of mold change, first the upper mold 1 is lowered from a state shown in FIG. 8 to close the upper mold 1 and the lower mold 2 as shown in FIG. 10. Then, attachment of the upper mold 1 by the upper frame 5 is released so that the upper mold 1 is removed from the upper mold die base 3. Next, the mold closing cylinder 22 is operated to be shortened to raise the upper mold die base 3, and then the upper mold 1 is mounted on the lower mold 2. From this state, when the rotation actuator 16 performs the right-hand turn at about 45°, space above the upper mold 1 and the lower mold 2, which are matched with each other, is opened. In this state, when the lower mold 2 is removed from the lower mold die base 4, the integrated upper mold 1 and lower mold 2 can be removed from the casting apparatus 50. In addition, when another integrated upper mold 1 and lower mold 2 is attached to the lower mold die base 4 in a state where the upper mold 1 and the lower mold 2 are removed and then reverse operation is performed, it is possible to safely and easily perform the mold change.

As described above, the casting apparatus 50 of the casting equipment 100 includes the parallel link mechanism that is formed by coupling the upper frame 5 to which the upper mold 1 is attached, the lower frame 6 to which the lower mold 2 is attached, and the left-and-right pairs of main link members 7 and of sub-link members 8, to each other. In addition, the tilt rotating shaft 10 is provided at a central portion of the main link member 7, as well as the sub-link central portion rotating shaft 15 is provided at a central portion of the sub-link member 8. Further, the tilt rotating shaft 10 is held in the base frame 17 with the tilt rotation bearings 9 provided outside the left-and-right pair of parallel link mechanisms, as well as the sub-link central portion rotating shaft 15 is mounted on the base frame 17 and the rotation actuator 16 is attached to the tilt rotating shaft 10 on a drive side support frame 19 side.

Accordingly, all steps of casting, such as mold closing, mold removal, and pushing out a product, are performed in the upper frame 5 and the lower frame 6 coupled by the parallel link mechanisms. Since force applied at the time of mold closing, mold removal, and pushing out a product, is received by only the parallel link mechanisms, a structure for securing strength of each of members is simplified as compared with the upper mold flip-up method. As a result, each of the members can be reduced in weight and simplified.

In addition, while large force is transferred to a base frame supporting an apparatus at the time of mold opening and the like in the apparatus of the upper mold flip-up method, the parallel link mechanism receives force in the casting apparatus 50 of the casting equipment 100, whereby it is possible to reduce force to be transferred to the base frame 17 supporting the apparatus. Accordingly, the base frame 17 also can be reduced in weight and simplified. Further, as compared with the apparatus by the upper mold flip-up method, it is possible to reduce the number of actuators by using the parallel link mechanisms. Furthermore, since rising operation of the upper mold 1 enables a casting to be removed from the upper mold 1, it is possible to reduce the number of actuators. Reduction of the casting apparatus 50 in size in this way enables a space occupied by the casting equipment 100 to be reduced. Accordingly, it is possible to reduce manufacturing costs of a casting.

The casting equipment 100 includes the plurality of casting apparatuses 50, and allows the pouring apparatus 60 to transfer and pour molten metal to each of the plurality of casting apparatuses 50 from the holding furnace 52. As described above, since each of the casting apparatuses 50 is reduced in size, it is possible to arrange each of the casting apparatuses 50 by reducing an interval between each other. As a result, it is possible to reduce a burden on the pouring apparatus 60 as well as on an operator who moves between each of the casting apparatuses 50. That is, the burden of the pouring apparatus 60 is reduced because a moving distance thereof in a lateral direction in which the plurality of casting apparatuses 50 align at the time of transferring and pouring molten metal is shortened. The burden on the operator is reduced because a walking distance thereof in the lateral direction at the time of setting a core in each of the casting apparatuses 50, mold change of each of the casting apparatuses 50, and the like, is shortened. For example, if a distance between two casting apparatuses 50 arranged is shortened by 600 mm, a walking distance of the operator at the time of setting a core is shortened by 600 mm×2 (one round-trip) than previous arrangement. In a case of three casting apparatuses 50, a walking distance of the operator at the time of setting a core is shortened by 1200 mm×2 (one round-trip) than previous arrangement.

The casting apparatus 50 enables safe and easy mold change as compared with an apparatus by the upper mold flip-up method. In addition, since the upper mold 1 and the lower mold 2 slide by operation of the parallel link mechanisms, it is possible to fit a core in safety in a state where a space above the lower mold 2 is opened.

The pouring apparatus 60 pours molten metal into the ladle 25 when the upper mold 1 and the lower mold 2 become the mold closed state. Thus, it is possible to shorten time from a start of pouring the molten metal into the ladle 25 to a start of pouring the molten metal into the upper mold 1 and the lower mold 2 in a tilted manner while the upper mold 1 and the lower mold 2 are tilted, as compared with a case where the molten metal is poured into the ladle 25 before the upper mold 1 and the lower mold 2 become the mold closed state.

The casting equipment 100 includes an interlock function that is realized by the sensor 79, the casting apparatus controller 78, the central controller 70, and the pouring apparatus controller 77. Since the pouring apparatus 60 is configured not to pour the molten metal into the ladle 25 when the upper mold 1 and the lower mold 2 are not in the mold closed state, a procedure, in which the pouring apparatus 60 pours the molten metal in a state (posture) where the casting apparatus 50 is ready to receive the molten metal, is obeyed to improve safety.

The pouring apparatus 60 starts transferring the molten metal before the casting apparatus 50 is ready to receive the molten metal. Accordingly, the molten metal is fed to a position at which the molten metal can be poured into the ladle 25 before the upper mold 1 and the lower mold 2 become the mold closed state, and then the molten metal is poured into the ladle 25 when the upper mold 1 and the lower mold 2 become the mold closed state. As a result, productivity is improved as compared with a case where the pouring apparatus 60 transfers and pours the molten metal to the casting apparatus 50 after the upper mold 1 and the lower mold 2 become the mold closed state.

Second Embodiment

Casting equipment in accordance with a second embodiment has the same basic configuration as that of the casting equipment 100 in accordance with the first embodiment. The casting equipment in accordance with the second embodiment is different from the casting equipment 100 in accordance with the first embodiment in operation of the casting apparatus 50 and the pouring apparatus 60. Hereinafter, a difference between the casting equipment in accordance with the second embodiment and the casting equipment 100 in accordance with the first embodiment will be mainly described without duplicated description.

Figure 15:
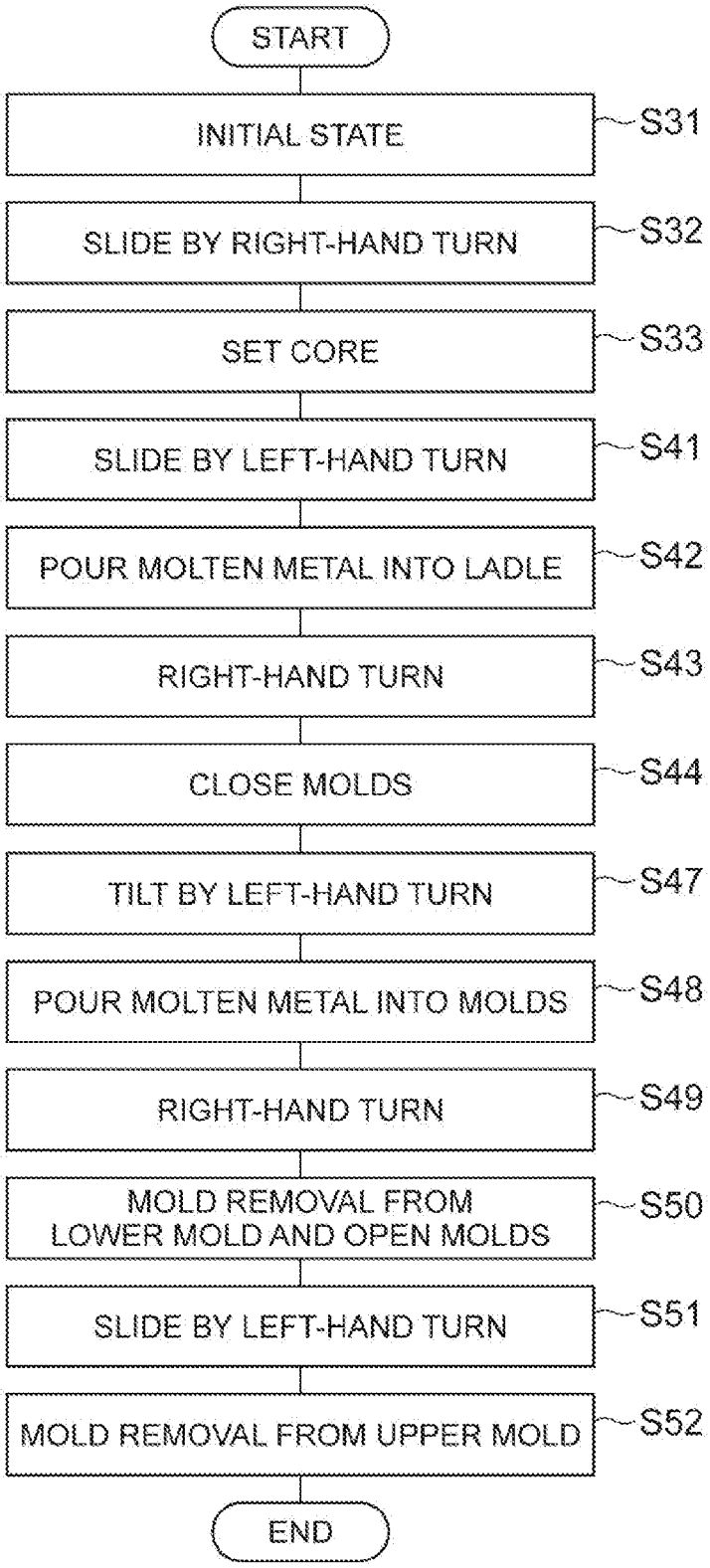
FIG. 15 is a flow chart showing a casting method using casting equipment in accordance with a second embodiment.

FIG. 15 is a flow chart showing a casting method using casting equipment in accordance with the second embodiment. As shown in FIG. 15, first, steps S31 to S33 are performed. The steps S31 to S33 are the same as the steps S11 to S13 of the casting method in accordance with the first embodiment. Subsequently, as shown in FIGS. 14 and 15, the casting apparatus 50 allows the rotation actuator 16 to perform the left-hand turn to allow the upper mold 1 and the lower mold 2 to slide in the left direction along an arc (S41). Then, the upper mold 1 and the lower mold 2 become the first separation state where the lower mold 2 moves in a direction approaching the pouring apparatus 60 (refer to FIG. 1).

Next, the pouring apparatus 60 (refer to FIG. 1) supplies molten metal to the ladle 25 (S42). Specifically, in the step S41 described above, when the upper mold 1 and the lower mold 2 become the first separation state, the pouring apparatus 60 supplies the molten metal to the casting apparatus 50. The pouring apparatus 60 may scoop molten metal in the holding furnace 52 with the ladle 62 (refer to FIG. 2) before the upper mold 1 and the lower mold 2 become the first separation state, and may move the ladle 62 to a position at which the molten metal can be poured into the ladle 25 to prepare pouring.

In a case where the upper mold 1 and the lower mold 2 are in the first separation state, the casting apparatus 50 outputs information showing the first separation state to the pouring apparatus 60. The pouring apparatus 60 does not pour the molten metal into the ladle 25 when receiving no information from the casting apparatus 50. Accordingly, even if there is a malfunction or a misoperation of the apparatus, a procedure, in which the pouring apparatus 60 pours the molten metal in a state (posture) where the casting apparatus 50 is ready to receive the molten metal, is obeyed. This kind of so-called interlock function is realized with cooperation of the sensor 79, the casting apparatus controller 78, the central controller 70, and the pouring apparatus controller 77. The interlock function may be realized without intervention of the central controller 70.

Subsequently, the casting apparatus 50 allows the rotation actuator 16 to perform the right-hand turn so that the casting apparatus 50 returns to the initial state of FIG. 8 (S43). Next, as shown in FIGS. 10 and 15, the casting apparatus 50 allows the mold closing cylinder 22 to elongate to close the upper mold 1 and the lower mold 2 (S44).

Then, as shown in FIG. 15, steps S47 to S52 are performed. The steps S47 to S52 are the same as the steps S17 to S22 of the casting method in accordance with the first embodiment. As described above, the series of casting steps is completed, and then the casting is formed by the casting equipment. In addition, it is possible to continuously form castings by repeating the casting steps above.

As described above, the casting equipment in accordance with the present embodiment allows the pouring apparatus 60 to pour the molten metal into the ladle 25 when the upper mold 1 and the lower mold 2 become the first separation state where the lower mold 2 is moved in the direction approaching the pouring apparatus 60 by the rotation actuator 16, after the upper mold 1 and the lower mold 2 are opened by the mold closing mechanism 21. Accordingly, as the lower mold 2 is moved in the direction approaching the pouring apparatus 60, the ladle 25 approaches the pouring apparatus 60. Thus, since a distance in which the pouring apparatus 60 transfers the molten metal is shortened, a burden on the pouring apparatus 60 is reduced.

The pouring apparatus 60 pours the molten metal into the ladle 25 when the upper mold 1 and the lower mold 2 become the first separation state after the upper mold 1 and the lower mold 2 are opened. Thus, since a distance in which the pouring apparatus 60 transfers the molten metal is shortened, a burden on the pouring apparatus 60 is reduced.

The casting equipment includes an interlock function that is realized by the sensor 79, the casting apparatus controller 78, the central controller 70, and the pouring apparatus controller 77. Since the pouring apparatus 60 is configured not to pour the molten metal into the ladle 25 when the upper mold 1 and the lower mold 2 are not in the first separation state, a procedure, in which the pouring apparatus 60 pours the molten metal in a state (posture) where the casting apparatus 50 is ready to receive the molten metal, is obeyed to improve safety.

Third Embodiment

Figure 16:
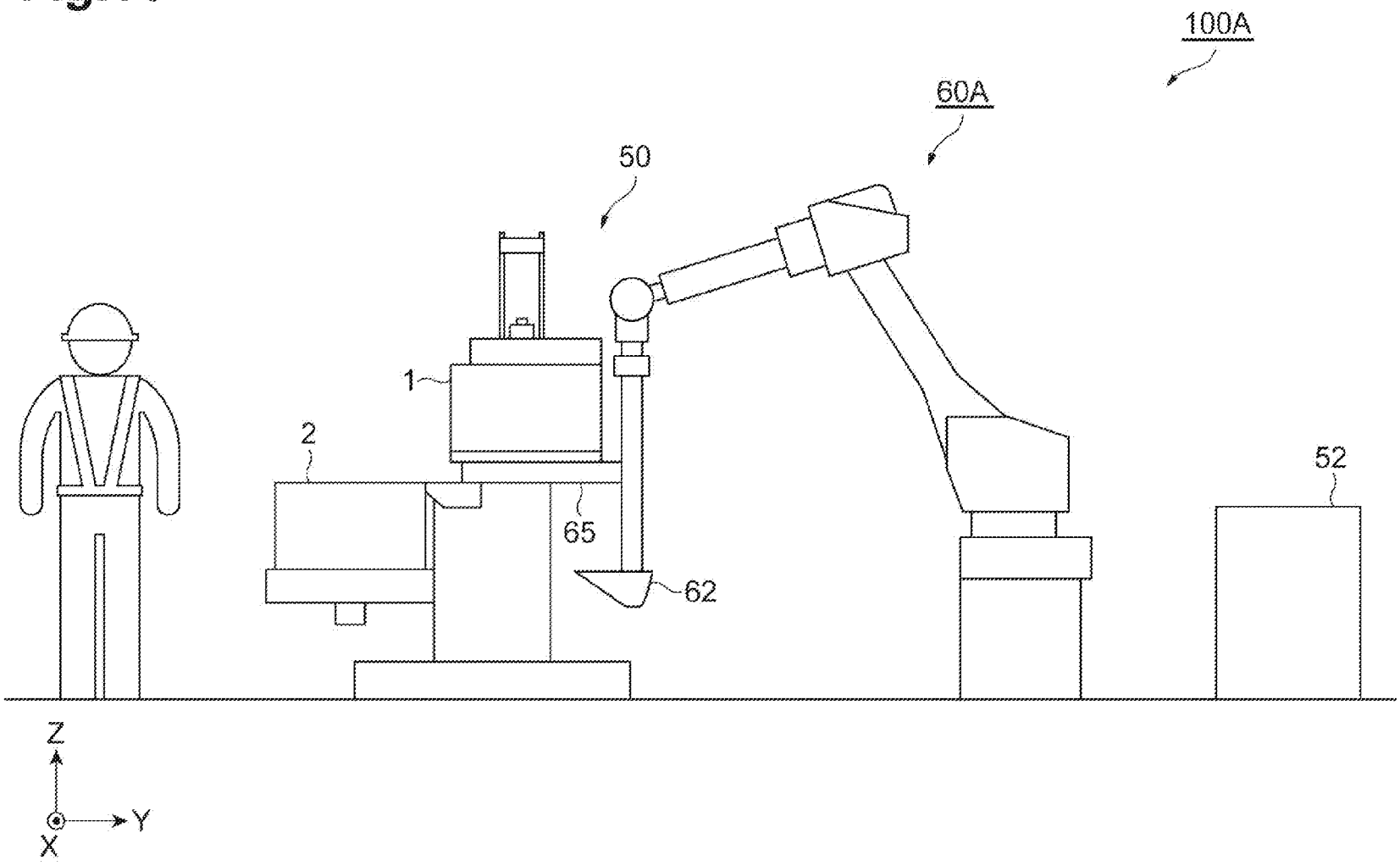
FIG. 16 is a side view of a part of casting equipment in accordance with a third embodiment.
Figure 17:
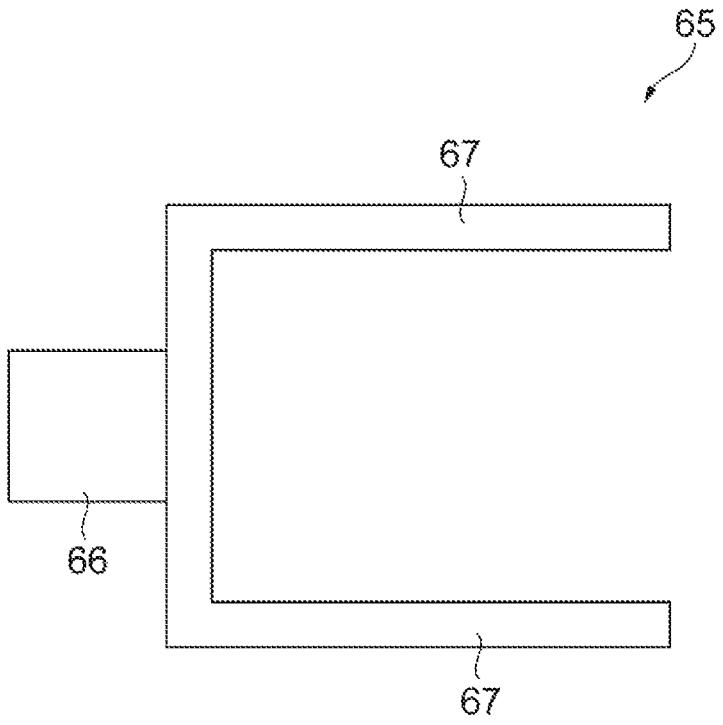
FIG. 17 is a plan view of a fork shown in FIG. 16.

Next, with reference to FIGS. 16 and 17, casting equipment in accordance with a third embodiment will be described. FIG. 16 is a side view of a part of casting equipment in accordance with the third embodiment. FIG. 17 is a plan view of a fork shown in FIG. 16.

As shown in FIGS. 16 and 17, casting equipment 100A in accordance with the third embodiment is different from the casting equipment 100 in accordance with the first embodiment in that a pouring apparatus 60A includes a fork (receiving unit) 65 for receiving a casting from the upper mold 1, and others are the same as those of the casting equipment 100. The fork 65 is attached to the arm 61 with an attachment part 66 above the ladle 62. The fork 65 includes a pair of at 67 branching and extending in parallel from the attachment part 66. The fork 65 may be fainted in a shape corresponding to a shape of a casting, by using a flat-shaped member, a member provided in its upper face with a recessed portion, and the like, for example.

A casting method using the casting equipment 100A is performed as with the casting method using the casting equipment 100 up to the step S20 shown in FIG. 7. In the step S21 shown in FIG. 7, the casting apparatus 50 allows the rotation actuator 16 to perform the right-hand turn instead of the left-hand turn. Accordingly, the upper mold 1 is moved toward the pouring apparatus 60 to become the second separation state. Then, the pouring apparatus 60A arranges the fork 65 below the upper mold 1 so that each of the arms 67 is parallel to the lower face of the upper mold 1. Next, a casting is removed from the upper mold 1 as with the step S22 shown in FIG. 7. The casting removed from the upper mold 1 drops to be received by the fork 65 instead of the conveyor 53. In this way, the fork 65 receives a casting from the upper mold 1 in the second separation state. The pouring apparatus 60A may convey the casting received to a predetermined place provided in an installation space of the casting equipment 100A, for example. The casting may be conveyed to a product finishing apparatus or the like from the predetermined place by a conveyance means, such as a conveyor.

As described above, in the casting equipment 100A in accordance with the present embodiment, the pouring apparatus 60 includes the fork 65 to receive a casting. As a result, it is possible to further reduce a space occupied by the casting equipment 100A as compared with a case where a receiving means is separately provided.

Fourth Embodiment

Figure 18:
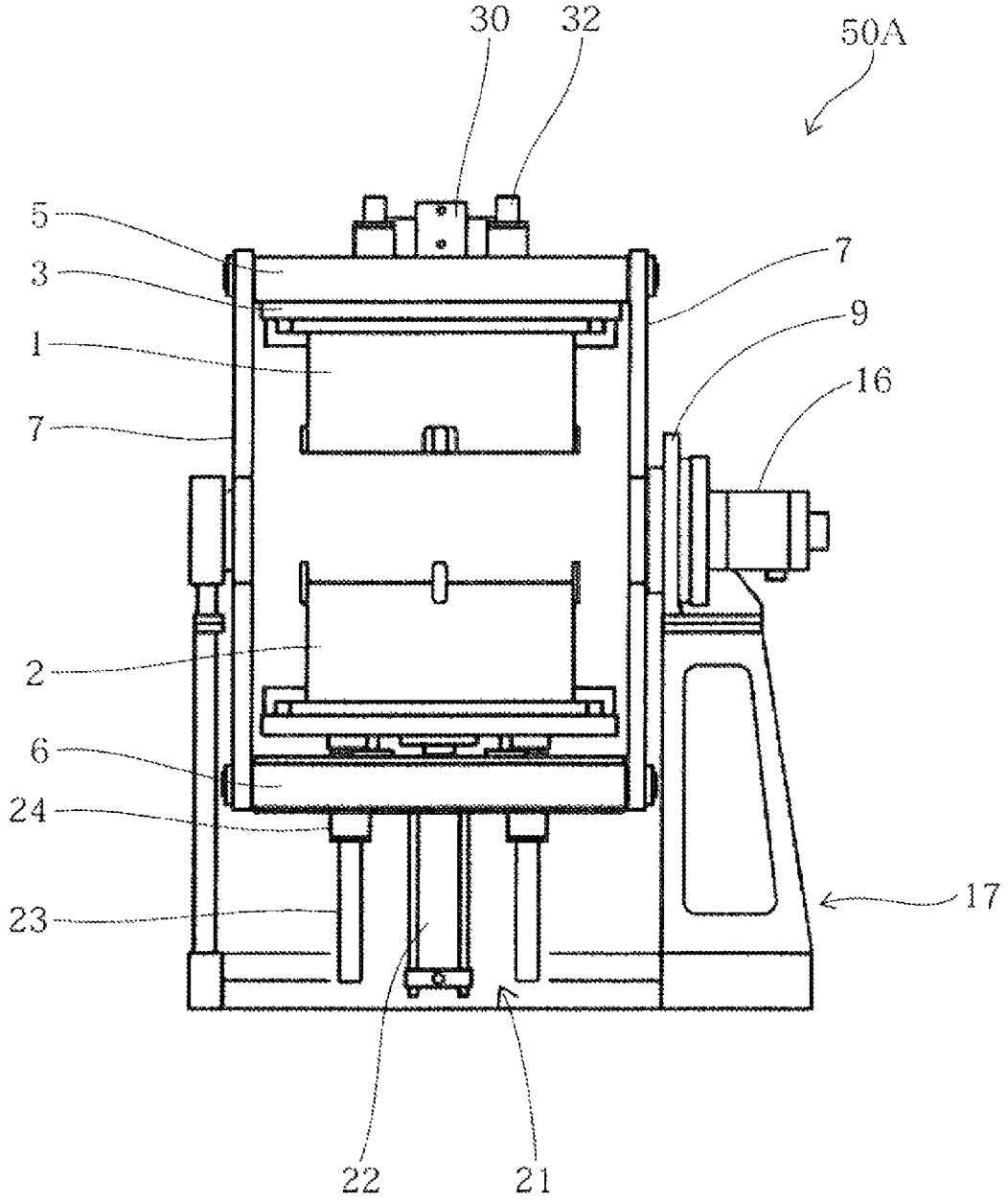
FIG. 18 is a front view of a casting apparatus in casting equipment in accordance with a fourth embodiment.

FIG. 18 is a schematic structural front view of a casting apparatus in casting equipment in accordance with a fourth embodiment. As shown in FIG. 18, a casting apparatus 50A in accordance with the fourth embodiment is mainly different from the casting apparatus 50 in accordance with the first embodiment in that the mold closing mechanism 21 that moves the lower mold 2 up and down is provided in the lower frame 6 and the pushing out cylinder 30 is provided in the upper frame 5. Accordingly, in the casting apparatus 50A, the lower mold 2 is able to be moved up and down.

When mold change is performed, first, the lower mold 2 is raised from a state shown in FIG. 18 to a state where the lower mold 2 and the upper mold 1 close. Then, attachment of the upper mold 1 by the upper frame 5 is released so that the upper mold 1 is removed from the upper mold die base 3. Next, the lower frame 6 is lowered while the upper mold 1 is mounted on the lower mold 2, and each of the upper frame 5 and the lower frame 6 is moved in a relatively reverse direction by operation of the parallel link mechanism. Then, the upper mold 1 and the lower mold 2 are removed from the lower frame 6, and another upper mold 1 and lower mold 2 are attached on the lower frame 6. According to the procedure describe above, mold change can be performed.

Fifth Embodiment

Figure 19:
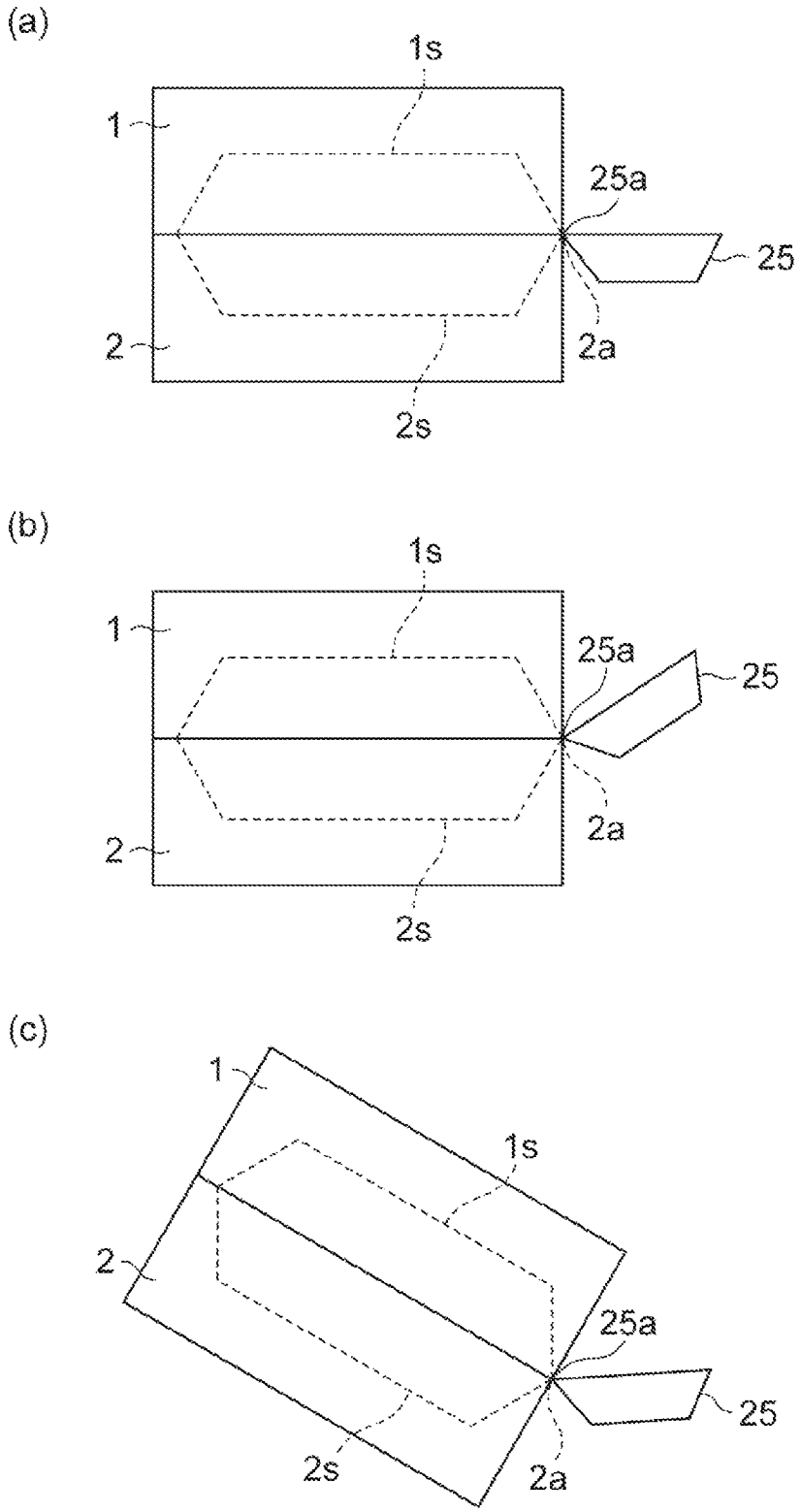
FIG. 19 is an illustration to describe a ladle of a casting apparatus in casting equipment in accordance with a fifth embodiment.

FIG. 19 is an illustration to describe a casting apparatus in accordance with a fifth embodiment. In consideration of easy understanding of description, each of an inner surface 1*s* of the upper mold 1 and an inner surface 2*s* of the lower mold 2 is here shown in a virtual shape. The ladle 25 shown in a portion (a) in FIG. 19 is attached horizontally to the lower mold 2. In contrast, as shown in a portion (b) in FIG. 19, the ladle 25 of the casting apparatus in accordance with the fifth embodiment is attached to the lower mold 2 while tilting in a tilt direction in which the upper mold 1 and the lower mold 2 are tilted. The tilt direction is a direction in which the upper mold 1 and the lower mold 2 are to be tilted when molten metal in the ladle 25 is poured into the upper mold 1 and the lower mold 2 in a tilted manner. Here, the tilt direction is a direction of the left-hand turn. That is, the tilt direction is a direction in which the ladle 25 is turned to the left around a connection portion between the pouring port 25*a* of the ladle 25 and the receiving port 2*a* of the lower mold 2. A turning angle in a case where the ladle 25 is turned to the left from the portion (a) to the portion (b) in FIG. 19 corresponds to an attachment angle of the ladle 25 to the lower mold 2. The attachment angle of the ladle 25 is set at an appropriate angle within a range from 5° to 30°, for example, depending on a plan.

When molten metal is poured into the ladle 25 attached in a tilted manner as described above, the ladle 25 is set to be horizontal as shown in a portion (c) in FIG. 19. That is, a casting method in accordance with the fifth embodiment further includes a step of allowing the rotation actuator 16 to perform the right-hand turn to tilt the upper mold 1 and the lower mold 2 between steps corresponding to the step S15 and the step S16, described above of the casting method in accordance with the first embodiment. In this step, an angle of the right-hand turn of the rotation actuator 16 is the attachment angle described above, for example.

Since the ladle 25 is attached in a tilted state as described above, when molten metal is poured into the upper mold 1 and the lower mold 2 from the ladle 25 in a tilted manner, the molten metal is poured into the upper mold 1 and the lower mold 2 from the ladle 25 through the pouring port 25*a* and the receiving port 2*a* so as to flow along the inner surface 2*s* of the lower mold 2. As a result, suction of air and an oxide film hardly occurs, thereby enabling quality of a casting to be improved.

Although each of the embodiments has been described above, the present invention is not limited to each of the embodiments described above. For example, instead of taking out a casting from the upper mold 1 or the lower mold 2 by using the pushing out cylinder 30, the pushing out plate 28 may be pushed by a spring. In that case, at the time of closing the upper mold 1 and the lower mold 2, since the upper mold 1 pushes down the return pin 27 of the lower mold 2 to lower the pushing out pin 26, mold closing force is offset equivalent to pushing down force of the return pin 27, however, it is possible to reduce the number of actuators.

In addition, the mold closing cylinder 22 and the pushing out cylinder 30 may be any one of electrically-operated, hydraulically-operated, and pneumatically-operated. From the viewpoint of handling molten metal, each of the cylinders may be electrically-operated, pneumatically-operated, or hydraulically-operated without using flammable hydraulic oil. Arrangement of each of the casting apparatuses 50 or 50A is not restricted if it is possible to pour molten metal by using the pouring apparatus 60 or 60A. Thus, for example, each of the casting apparatuses may be arranged in a circle so as to surround the pouring apparatus 60 or 60A. The number of each of apparatuses, such as the casting apparatuses 50 or 50A, the holding furnaces 52, the core molding apparatuses 54, and the pouring apparatuses 60 or 60A, may be one or more. In addition, operation of setting a core may be performed by a core setting robot with a multiple joint structure instead of an operator, for example.

REFERENCE SIGNS LIST

1 upper mold, 1*s* . . . inner surface, 2 . . . lower mold, 2*a* . . . receiving port, 2*s* . . . inner surface, 5 . . . upper frame, 6 . . . lower frame, 7 . . . main link member, 8 . . . sub-link member, 10 . . . tilt rotating shaft, 16 . . . rotation actuator (drive means), 17 . . . base frame, 21 . . . mold closing mechanism, 25 . . . ladle, 25*a* . . . pouring port, 26 . . . pushing out pin, 27 . . . return pin, 28 . . . pushing out plate, 29 . . . push rod, 50,50A . . . casting apparatus, 52 . . . holding furnace, 53 . . . conveyor, 54 . . . core molding apparatus, 60, 60A . . . pouring apparatus, 65 . . . fork (receiving unit), 70 . . . central controller, 77 . . . pouring apparatus controller, 78 . . . casting apparatus controller, 79 . . . sensor, 100,100A . . . casting equipment.

The invention claimed is:

1. Casting equipment comprising:

a casting apparatus that forms a casting by using an upper mold and a lower mold, which can be opened, closed, and tilted, into which molten metal is poured by using gravity;

a holding furnace that stores the molten metal to be used in the casting apparatus; and a pouring apparatus that transfers the molten metal to the casting apparatus from the holding furnace and pours the molten metal into the casting apparatus, the casting apparatus including:

an upper frame to which an upper mold is attached;

a lower frame to which a lower mold is attached;

a mold closing mechanism that is provided in the upper frame to move the upper mold up and down, or that is provided in the lower frame to move the lower mold up and down;

a pair of main link members each of which has upper and lower ends that are rotatably coupled to the upper and lower frames, respectively, to be oppositely arranged, and has a central portion that is provided with a rotating shaft;

a pair of auxiliary link members arranged parallel to the respective main link members, and each of which has upper and lower ends that are rotatably coupled to the upper and lower frames, respectively, to be oppositely arranged, and has a central portion that is provided with a rotating shaft; and a drive means that is provided to be coupled to the rotating shaft of one of the pair of main link members, and that tilts the upper mold and the lower mold or horizontally moves the molds away from each other, wherein the upper frame, the lower frame, the main link member, and the auxiliary link member constitute a parallel link mechanism.

2. The casting equipment according to claim 1, wherein the casting apparatus further includes a ladle attached to the lower mold, the ladle including:

a storage section formed inside the ladle for storing molten metal; and a pouring port connected to a receiving port of the lower mold, and wherein the pouring apparatus pours the molten metal into the ladle when the upper mold and the lower mold are closed by the mold closing mechanism to become a mold closed state.

3. The casting equipment according to claim 2, wherein the pouring apparatus and the casting apparatus are communicatively connected to each other, and wherein the casting apparatus outputs information showing the mold closed state to the pouring apparatus when the upper mold and the lower mold are in the mold closed state, and then the pouring apparatus does not pour the molten metal into the ladle when receiving no information from the casting apparatus.

4. The casting equipment according to claim 3, wherein the ladle is attached to the lower mold while inclined in a tilt direction in which the upper mold and the lower mold are tilted.

5. The casting equipment according to claim 3, wherein the pouring apparatus starts transferring the molten metal before the casting apparatus is ready to receive the molten metal.

6. The casting equipment according to claim 3, comprising a plurality of the casting apparatuses, wherein the pouring apparatus transfers and pours the molten metal to each of the plurality of casting apparatuses from the holding furnace.

7. The casting equipment according to claim 2, wherein the ladle is attached to the lower mold while inclined in a tilt direction in which the upper mold and the lower mold are tilted.

8. The casting equipment according to claim 7, wherein the pouring apparatus starts transferring the molten metal before the casting apparatus is ready to receive the molten metal.

9. The casting equipment according to claim 2, wherein the pouring apparatus starts transferring the molten metal before the casting apparatus is ready to receive the molten metal.

10. The casting equipment according to claim 2, comprising a plurality of the casting apparatuses, wherein the pouring apparatus transfers and pours the molten metal to each of the plurality of casting apparatuses from the holding furnace.

11. The casting equipment according to claim 1, wherein the casting apparatus further includes a ladle attached to the lower mold, the ladle including:

a storage section formed inside the ladle for storing molten metal; and a pouring port connected to a receiving port of the lower mold, wherein after the upper mold and the lower mold are opened by the mold closing mechanism, the pouring apparatus pours the molten metal into the ladle when the upper mold is moved in a direction away from the pouring apparatus and the lower mold is moved in a direction approaching the pouring apparatus, by the drive means, to become a first separation state where the upper mold and the lower mold are horizontally separated from each other.

12. The casting equipment according to claim 11, wherein the pouring apparatus and the casting apparatus are communicatively connected to each other, and wherein the casting apparatus outputs information showing the first separation state to the pouring apparatus when the upper mold and the lower mold are in the first separation state, and then the pouring apparatus does not pour the molten metal into the ladle when receiving no information from the casting apparatus.

13. The casting equipment according to claim 12, wherein the ladle is attached to the lower mold while inclined in a tilt direction in which the upper mold and the lower mold are tilted.

14. The casting equipment according to claim 12, wherein the pouring apparatus starts transferring the molten metal before the casting apparatus is ready to receive the molten metal.

15. The casting equipment according to claim 11 wherein the ladle is attached to the lower mold while inclined in a tilt direction in which the upper mold and the lower mold are tilted.

16. The casting equipment according to claim 11, wherein the pouring apparatus starts transferring the molten metal before the casting apparatus is ready to receive the molten metal.

17. The casting equipment according to claim 11, comprising a plurality of the casting apparatuses, wherein the pouring apparatus transfers and pours the molten metal to each of the plurality of casting apparatuses from the holding furnace.

18. The casting equipment according to claim 1, wherein the pouring apparatus starts transferring the molten metal before the casting apparatus is ready to receive the molten metal.

19. The casting equipment according to claim 1, comprising a plurality of the casting apparatuses, wherein the pouring apparatus transfers and pours the molten metal to each of the plurality of casting apparatuses from the holding furnace.

20. The casting equipment according to claim 1, wherein the pouring apparatus includes a receiving unit that receives a casting from the upper mold, and wherein after the upper mold and the lower mold are opened by the mold closing mechanism, the receiving unit receives a casting from the upper mold when the lower mold is moved in the direction away from the pouring apparatus and the upper mold is moved in the direction approaching the pouring apparatus, by the drive means, to become a second separation state where the upper mold and the lower mold are horizontally separated from each other.

* * * * *